US010345750B2

(12) United States Patent
Saito et al.

(10) Patent No.: US 10,345,750 B2
(45) Date of Patent: Jul. 9, 2019

(54) IMAGE FORMING APPARATUS

(71) Applicant: CANON KABUSHIKI KAISHA, Tokyo (JP)

(72) Inventors: Fumiyoshi Saito, Toride (JP); Katsuya Nose, Kashiwa (JP); Toshihisa Yago, Toride (JP); Naoki Mugita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/855,828

(22) Filed: Dec. 27, 2017

(65) Prior Publication Data

US 2018/0136598 A1 May 17, 2018

Related U.S. Application Data

(62) Division of application No. 14/953,639, filed on Nov. 30, 2015, now Pat. No. 9,897,959.

(30) Foreign Application Priority Data

Dec. 12, 2014 (JP) ..... 2014-252134

(51) Int. Cl.
*G03G 15/00* (2006.01)
*G03G 15/08* (2006.01)
*G03G 15/09* (2006.01)

(52) U.S. Cl.
CPC ..... *G03G 15/556* (2013.01); *G03G 15/0844* (2013.01); *G03G 15/09* (2013.01); *G03G 2215/0607* (2013.01)

(58) Field of Classification Search
CPC ..... G03G 15/556; G03G 15/508; G03G 15/0844; G03G 15/0877; G03G 15/0822
See application file for complete search history.

(56) References Cited

U.S. PATENT DOCUMENTS 7,095,966 B2 8/2006 Adachi ..... 399/27
9,557,683 B2 1/2017 Saito et al. ..... 15/829
(Continued)

FOREIGN PATENT DOCUMENTS

CN 103399471 11/2013
JP 2003-330234 11/2003
(Continued)

OTHER PUBLICATIONS

Office Action dated Aug. 7, 2018 in counterpart Japan Application No. 2014-252134, together with English translation thereof.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes: an image bearing member, a developing device, and a controller configured to execute an operation in a forced consumption mode. The controller includes a difference calculating portion, an integrating portion, and a flag. In a case where the flag is set when a predetermined time is elapsed after the integrated value exceeds the predetermined threshold, the image formation on the predetermined number of the recording materials is effected and then the controller executes the operation in the forced consumption mode, and in a case where the flag is reset when the predetermined time is elapsed after the integrated value exceeds the predetermined threshold, the image formation on the predetermined number of the recording materials is effected and then the controller continues an image forming operation without executing the operation in the forced consumption mode.

7 Claims, 13 Drawing Sheets

(56) References Cited

U.S. PATENT DOCUMENTS

| | | | | |
|---|---|---|---|---|
| 9,829,845 | B2 | 11/2017 | Nose | G03G 15/556 |
| 2004/0067069 | A1 | 4/2004 | Ogata | 399/27 |
| 2005/0025506 | A1* | 2/2005 | Adachi | G03G 21/1889 399/27 |
| 2010/0104300 | A1 | 4/2010 | Shinohara | 399/43 |
| 2011/0052220 | A1* | 3/2011 | Nose | G03G 15/0844 399/27 |
| 2013/0164005 | A1 | 6/2013 | Nose | 399/44 |
| 2013/0230332 | A1* | 9/2013 | Ishii | G03G 15/556 399/27 |
| 2013/0236201 | A1* | 9/2013 | Mizutani | G03G 15/1675 399/53 |
| 2014/0341597 | A1 | 11/2014 | Urayama et al. | 399/27 |

FOREIGN PATENT DOCUMENTS

| | | |
|---|---|---|
| JP | 2004-126245 | 4/2004 |
| JP | 2005-062840 | 3/2005 |
| JP | 2006-023327 | 1/2006 |
| JP | 2007-147780 | 6/2007 |
| JP | 2011-048083 | 3/2011 |
| JP | 2012-103317 | 5/2012 |
| JP | 2013-190469 | 9/2013 |

OTHER PUBLICATIONS

CN Office Action dated Mar. 25, 2019 in counterpart CN Application No. 201510918680 with English translation.

* cited by examiner

| THRESHOLD | | VIDEO COUNT Vt | COLOR | | | |
|---|---|---|---|---|---|---|
| | | | Y | M | C | K |
| PRINT RATIO | 0% | 0 | × | × | × | × |
| | 1% | 5 | ○ | × | ○ | × |
| | 2% | 10 | ○ | ○ | ○ | ○ |
| | 3% | 15 | ○ | ○ | ○ | ○ |
| | 4% | 20 | ○ | ○ | ○ | ○ |
| | 5% | 26 | ○ | ○ | ○ | ○ |

Fig. 7

| LOW-DUTY-BLACK | COLOR | | | |
|---|---|---|---|---|
| | Y | M | C | K |
| PRINT RATIO (%) | 5 | 5 | 5 | 1 |
| V | 26 | 26 | 26 | 5 |
| Vt | 5 | 10 | 5 | 10 |
| Vt-V | - 21 | - 16 | - 21 | 5 |
| ADDED TO X | - 21 | - 16 | - 21 | 5 |

| HIGH-DUTY-BLACK | COLOR | | | |
|---|---|---|---|---|
| | Y | M | C | K |
| PRINT RATIO (%) | 5 | 5 | 5 | 100 |
| V | 26 | 26 | 26 | 512 |
| Vt | 5 | 10 | 5 | 10 |
| Vt-V | - 21 | - 16 | - 21 | - 502 |
| ADDED TO X | - 21 | - 16 | - 21 | - 502 |

Fig. 10

IMAGE FORMING APPARATUS

This application is a division of application Ser. No. 14/953,639 filed Nov. 30, 2015, currently pending; and claims priority under 35 U.S.C. § 119 to Japan Application 2014-252134 filed in Japan on Dec. 12, 2014; and the contents of all of which are incorporated herein by reference as if set forth in full.

FIELD OF THE INVENTION AND RELATED ART

The present invention relates to an image forming apparatus, such as a copying machine, a printer, a facsimile machine or a multi-function machine having a plurality of functions of these machines. Particularly, the present invention relates to a constitution having an operation in a forced consumption mode in which a developer is forcedly consumed.

Generally, in the image forming apparatus of an electrophotographic type, when a proportion in which an image having a low image ratio (print ratio) is formed is large, a proportion of a toner transferred from a developing sleeve in a developing device onto a photosensitive drum becomes small. In such a state, when the developing device is continuously driven for a long time, toner deterioration generates, and therefore an image defect such as toner scattering or fog is liable to occur. For this reason, an operation in which the toner is forcedly consumed by the developing device has been conventionally performed.

For example, in the case where a value as an index of an amount of the toner used every image formation is smaller than a set threshold, a difference between the value and the set threshold is calculated, and when an integrated value obtained by integrating the calculated difference reaches a predetermined value, forced consumption of the toner is executed. Such invention has been proposed (Japanese Laid-Open Patent Application (JP-A) 2006-23327).

For example, in the case where an image for which a toner consumption amount is large (i.e., an image ratio is high) is formed immediately after a forced consumption operation of the toner is executed, the toner deterioration is eliminated in some cases by this image formation even when the forced consumption operation of the toner (operation in a forced consumption mode) immediately before the image formation is not executed. In such cases, the toner consumption amount by the forced consumption operation of the toner immediately before the image formation becomes excessive relative to a toner consumption amount necessary to eliminate the toner deterioration.

Particularly, in the case where downtime is provided during continuous image formation and the forced consumption operation of the toner is performed during the downtime, a time lag can generate from setting of an execution flag for the forced consumption operation of the toner until the forced consumption operation of the toner is actually executed. For example, the following case exists. FIG. 14 shows image forming timing at each of image forming stations (Yst, Mst, Cst, Kst) for yellow, magenta, cyan, black in a constitution of a so-called tandem type in which the image forming stations are arranged in a rotational direction of an intermediary transfer belt. In FIG. 14, the image forming timing at each of the image forming stations is shown along a time axis t. In this constitution, in the case where timing when an amount of the toner used every image formation is notified is image formation start timing for each of the colors, when the amount of the toner used for image formation on a first sheet at Kst is notified, image formation on a second sheet at Yst has already been started in some cases. Incidentally, the toner amount corresponds to a video count, and each of arrows in FIG. 14 represents notification timing from a controller. In this case, even if an execution flag for a forced consumption operation of the toner was set during the image formation on the first sheet at Kst, the forced consumption operation of the toner was not able to be executed and was executed after the image formation on the second sheet. Further, in order to ensure productivity, the controller notifies a feeding-enable signal for the second sheet to an image forming engine before the image formation on the first sheet in some cases. Also in such cases, even when the execution flag for the forced consumption operation of the toner was set during the image formation on the first sheet at Yst, the feeding-enable signal for the second sheet have already been notified, and therefore the forced consumption operation of the toner was executed after the image formation on the second sheet. In a conventional constitution, when this execution flag was set, the forced consumption operation of the toner was executed irrespective of a toner consumption amount until the forced consumption operation of the toner was actually executed.

However, in the case where an image large in toner consumption amount is formed in a period from the setting of the execution flag for the forced consumption operation of the toner until the forced consumption operation of the toner is actually executed, in some cases, toner deterioration is eliminated without executing the forced consumption operation of the toner. However, even in such a case, in the conventional constitution, the forced consumption operation of the toner was executed when the execution flag was set.

SUMMARY OF THE INVENTION

The present invention has been accomplished in view of the above-described circumferences. A principal object of the present invention is to provide an image forming apparatus capable of suppressing a toner consumption amount while suppressing toner deterioration in a constitution in which an operation in a forced consumption mode is executable.

According to an aspect of the present invention, there is provided an image forming apparatus comprising: an image bearing member; a developing device configured to develop an electrostatic latent image, formed on the image bearing member, with a toner; and a controller configured to execute an operation in a forced consumption mode during a continuous image forming job for forming images on a plurality of recording materials continuously, and in the operation in the forced consumption mode, the toner is forcedly consumed by the developing device in a region of the image bearing member corresponding to a non-image forming region between a recording material and a subsequent recording material, wherein the controller includes, a difference calculating portion configured to calculate a difference between a consumption value depending on an amount of the toner consumed every predetermined unit of image formation and a reference value set for the predetermined unit, an integrating portion configured to integrate the difference to obtain an integral value, and a flag set when the integrated value is larger than a predetermined threshold and reset when the integrated value is smaller than the predetermined threshold, wherein in a case where the integrated value exceeds the predetermined threshold during the continuous image forming job, the controller permits the image formation on a predetermined number on the recording materials from a time when the integrated value exceeds the predetermined threshold, and wherein in a case where the flag is set when a predetermined time is elapsed after the integrated value exceeds the predetermined threshold, the image formation on the predetermined number of the recording materials is effected and then the controller executes the operation in the forced consumption mode, and in a case where the flag is reset when the predetermined time is elapsed after the integrated value exceeds the predetermined threshold, the image formation on the predetermined number of the recording materials is effected and then the controller continues an image forming operation without executing the operation in the forced consumption mode.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a table showing a result of an experiment in which a toner deterioration threshold video count Vt for each of colors is measured.

FIG. 10 includes tables showing parameters in the cases of low-duty-black and high-duty-black, respectively.

DESCRIPTION OF THE PREFERRED EMBODIMENTS

An embodiment of the present invention will be described with reference to FIGS. 1-13. First, a general structure of an image forming apparatus in this embodiment will be described with reference to FIGS. 1-3.

[Image Forming Apparatus]

Figure 1:
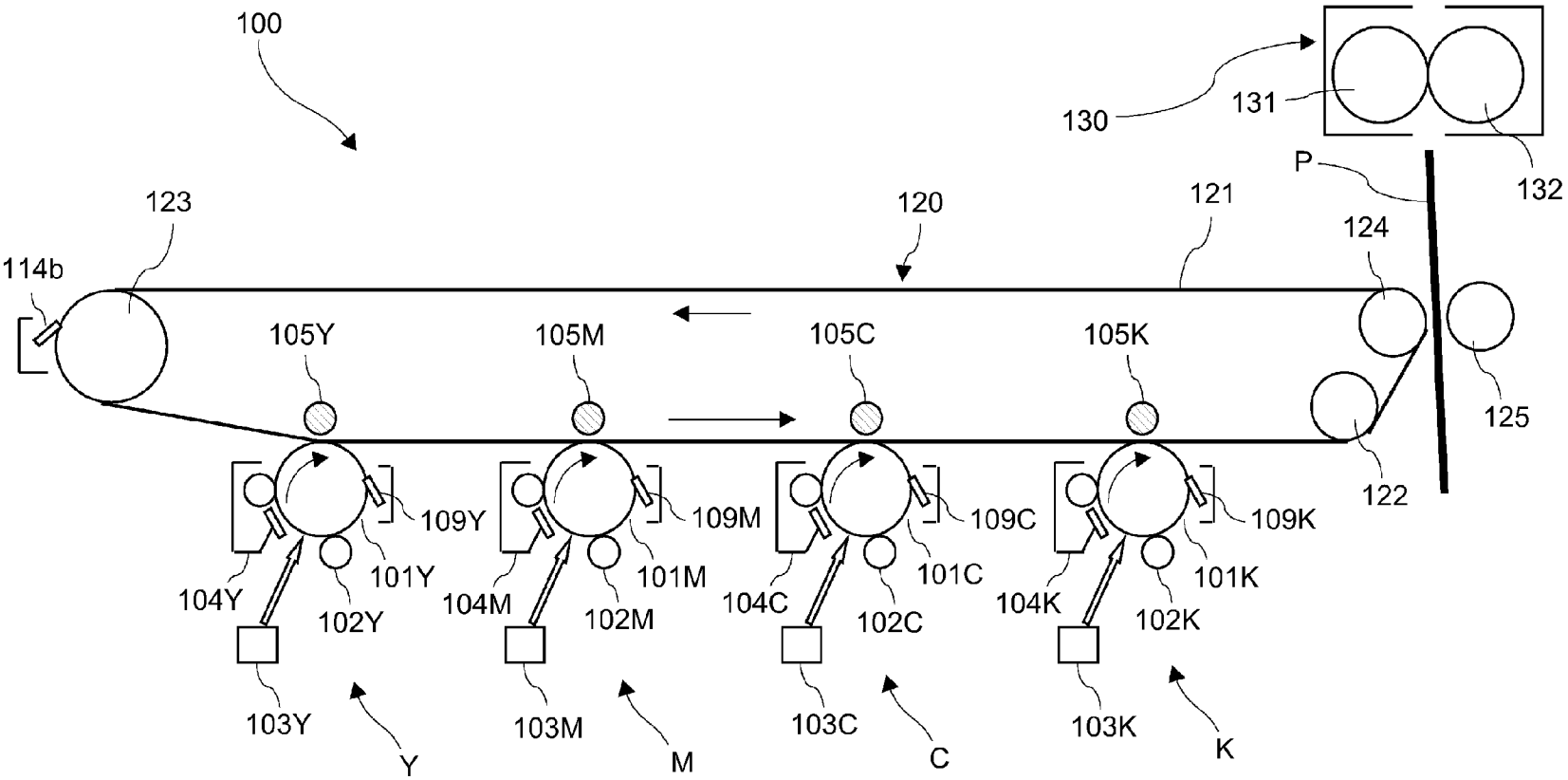
FIG. 1 is a schematic sectional view of an image forming apparatus according to an embodiment of the present invention.
Figure 2:
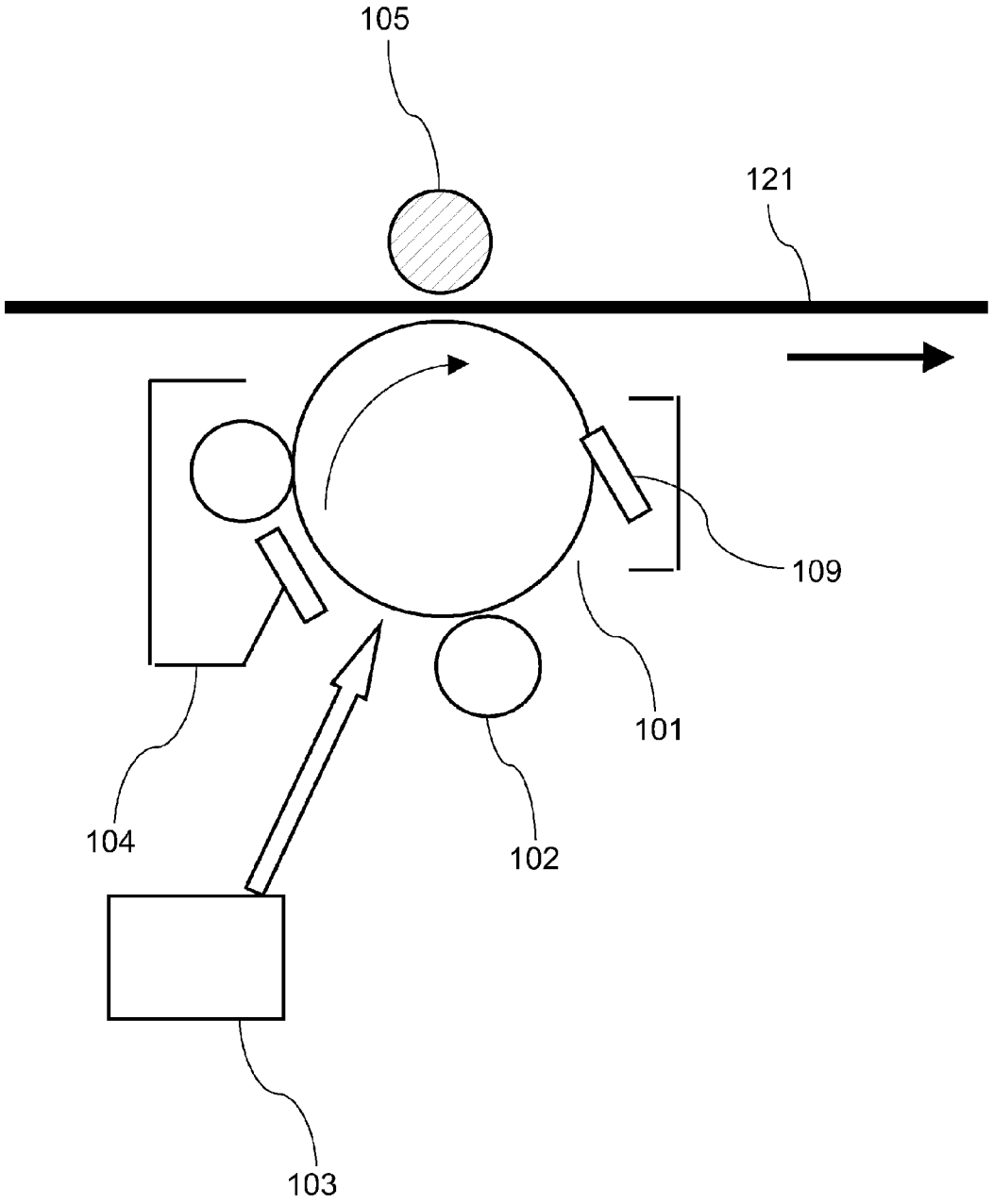
FIG. 2 is a schematic sectional view of an image forming station in the embodiment.

As shown in FIG. 1, an image forming apparatus 100 in this embodiment includes four image forming stations Y, M, C and K provided with photosensitive drums 101 (101Y, 101M, 101C and 101K) as an image bearing member. On each of the image forming stations, an intermediary transfer device 120 is disposed. The intermediary transfer device 120 is constituted so that an intermediary transfer belt 121 as an intermediary transfer member is stretched by rollers 122, 123 and 124 and is moved in a direction indicated by arrows.

At peripheries of the photosensitive drums 101, primary charging devices 102 (102Y, 102M, 102C and 102K), developing devices 104 (104Y, 104M, 104C and 104K), cleaners 109 (109Y, 109M, 109C and 109K) and the like are provided. Constitutions and an image forming operation at the peripheries of the photosensitive drums will be described with reference to FIGS. 1 and 2. The constitutions around the photosensitive drums for the respective colors are similar to each other, and therefore in the case where there is no need to particularly distinguish the constitutions, suffixes representing the constitutions of the image forming stations for the respective colors will be omitted from description.

The photosensitive drum 101 is rotationally driven in an arrow direction. The surface of the photosensitive drum 101 is electrically charged uniformly by the primary charging device 102 of a charging roller type using contact charging. The surface of the charged photosensitive drum 1 is exposed to light by a laser emitting device (element) 103 as an exposure device, s that an electrostatic latent image is formed. The thus-formed electrostatic latent image is visualized with a toner by the developing device 104, so that a toner image is formed on the photosensitive drum 101. At the image forming stations, the toner images of yellow (Y), magenta (M), cyan (C) and black (K) are formed, respectively.

The toner images formed at the respective image forming stations are transferred and superposed on the intermediary transfer belt 121 of polyimide resin by a transfer bias supplied through the primary transfer rollers 105 (105Y, 105M, 105C and 105K). The four-color toner images formed on the intermediary transfer belt 121 are transferred onto recording material (e.g., a sheet material such as a sheet (paper) or an OHP sheet) P by a secondary transfer roller 125 as a secondary transfer means disposed opposite to the roller 124. The toner remaining on the intermediary transfer belt 121 without being transferred onto the recording material P is removed by an intermediary transfer belt cleaner 114*b*. The recording material P on which the toner images are transferred is pressed and heated by a fixing device 130 including fixing rollers 131 and 132, so that the toner image is fixed. Further, primary transfer residual toners remaining on the photosensitive drums 101 after the primary transfer are removed by cleaners 109, so that the image forming apparatus prepares for subsequent image formation.

Next, a system constitution of an image processing unit in the image forming apparatus 100 in this embodiment will be described with reference to FIG. 3.

Figure 3:
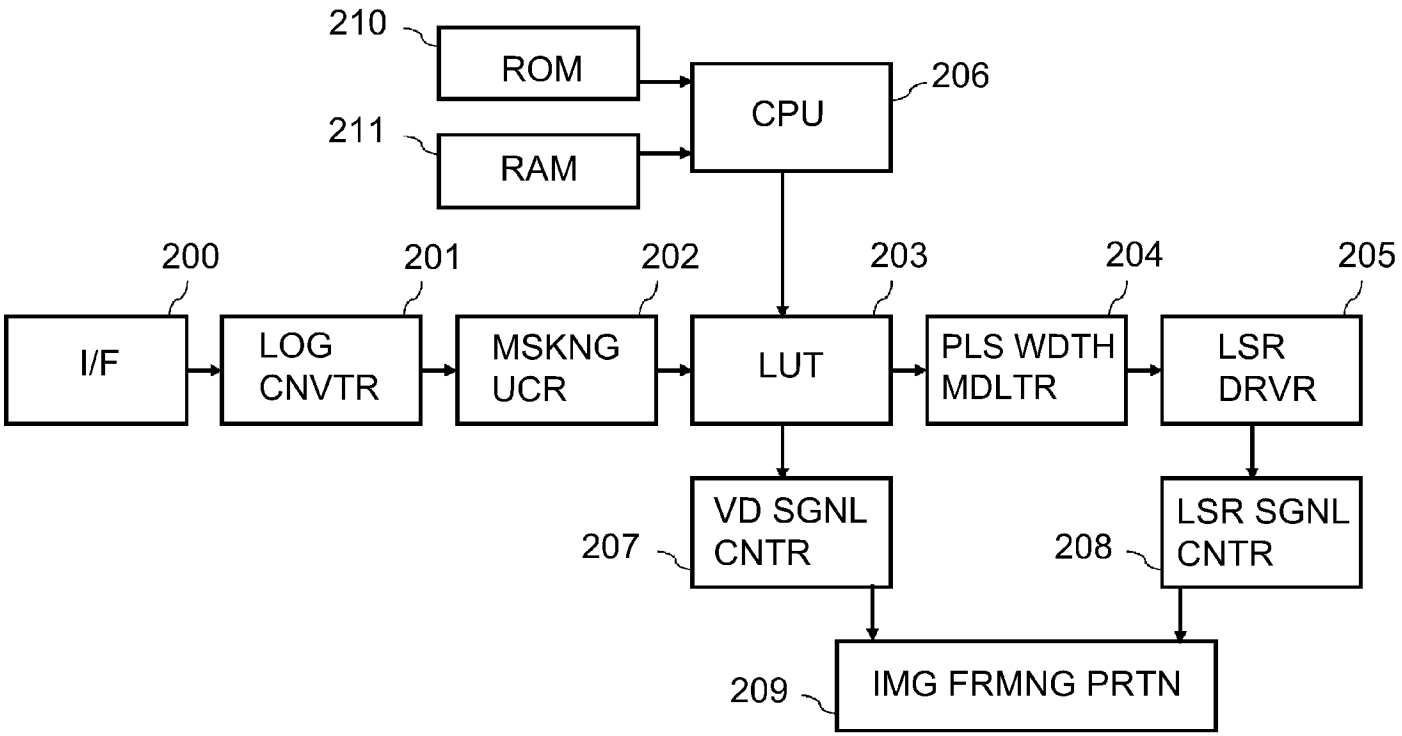
FIG. 3 is a block diagram showing a system constitution of the image forming apparatus in the embodiment.

Referring to FIG. 3, through an external input interface (I/F) 200, color image data as RGB image data are inputted from an unshown external device such as an original scanner or a computer (information processing device) as desired. A LOG conversion portion 201 converts luminance data of the inputted RGB image data into CMY density data (CMY image data) on the basis of a look-up table constituted (prepared) by data or the like stored in an ROM 210. A masking UCR portion 202 extracts a black (K) component data from the CMY image data and subjects CMYK image data to matrix operation in order to correct color shading of a recording colorant. A look-up table portion (LUT portion) 203 makes density correction of the inputted CMYK image data every color by using a gamma (γ) look-up table in order that the image data are caused to coincide with an ideal gradation characteristic of a printer portion. Incidentally, the γ look-up table is prepared on the basis of the data developed on an RAM 211 and the contents of the table are set by a CPU 206. A pulse width modulation portion 204 outputs a pulse signal with a pulse width corresponding to image data (image signal) inputted from the LUT portion 203. On the basis of this pulse signal, a laser driver 205 drives the laser emitting element 103 to irradiate the surface of the photosensitive drum 101 with laser light, so that the electrostatic latent image is formed on the photosensitive drum 101.

A video signal count portion 207 adds up a level for each pixel (0 to 255 level) for a screenful of the image (with respect to 600 dpi in this embodiment) of the image data inputted into the LUT portion 203. The integrated value of the image data is referred to as a video count value. A maximum of this video count value is 1023 in the case where all the pixels for the output image are at the 255 level. Incidentally, when there is a restriction on the constitution of the circuit, by using a laser signal count portion 208 in place of the video signal count portion 207, the image signal from the laser driver 205 is similarly calculated, so that it is possible to obtain the video count value.

The image forming portion 209 drive-controllers a constitution of each of the respective portions of the respective image forming stations described above. For example, the laser driver 205 drives the laser emitting element 103 via the image forming portion 209 by a pulse signal on the basis of the image data. The CPU 206 causes the image forming portion 209 to execute an operation in a forced consumption mode as described later on the basis of information such as a video count obtained by the video signal count portion 207.

[Developing Device]

Figure 4:
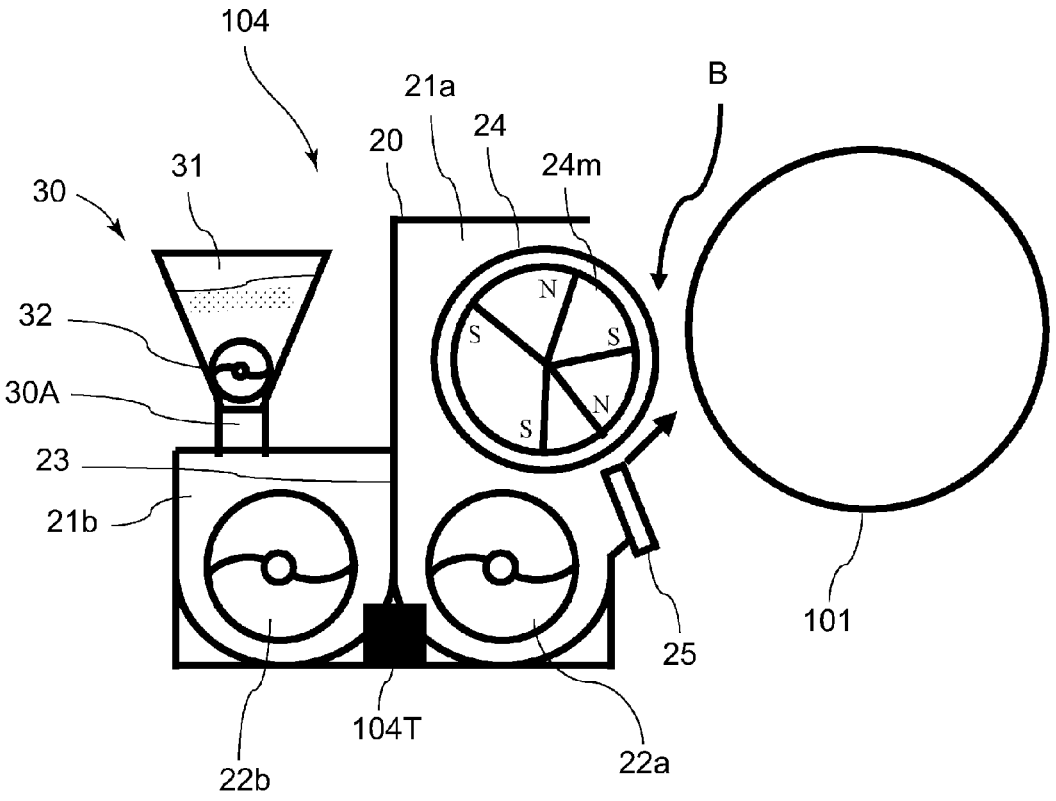
FIG. 4 is a schematic cross-sectional view of a developing device in the embodiment.
Figure 5:
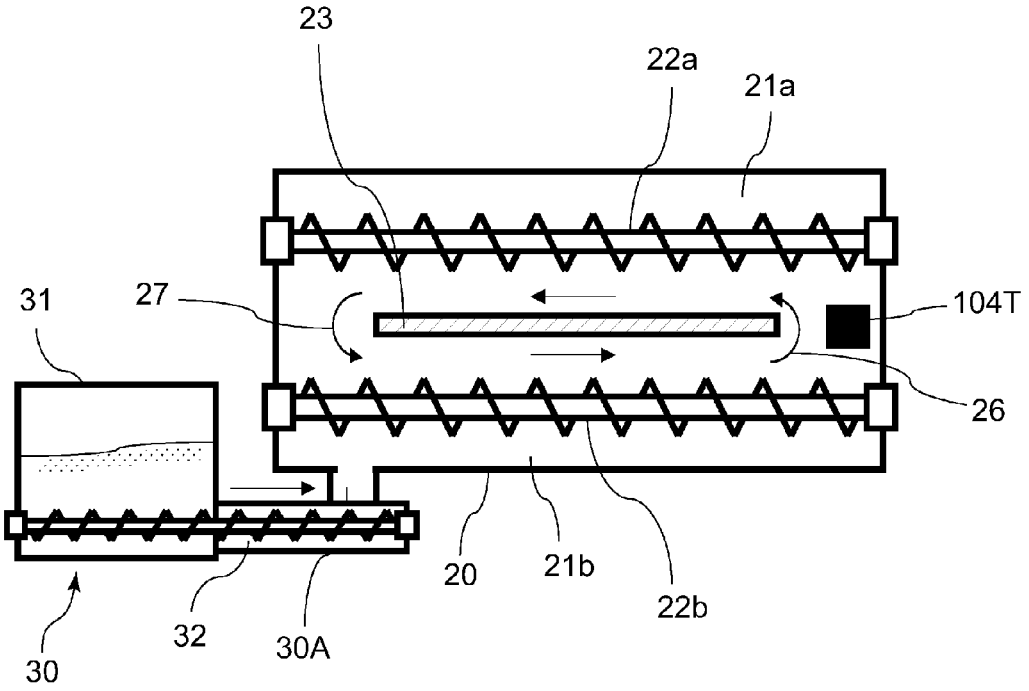
FIG. 5 is a schematic longitudinal sectional view of the developing device in the embodiment.
Figure 6:
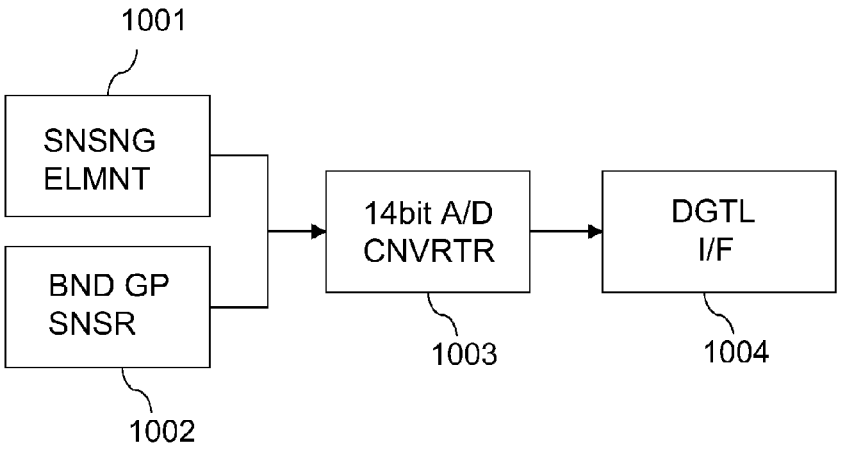
FIG. 6 is a control block diagram of a temperature sensor provided in the developing device in the embodiment.

The developing device 104 in this embodiment will be further described specifically with reference to FIGS. 4-6. The developing device 104 in this embodiment includes a developing container 20, in which a two component developer including a toner and a carrier is stored. The developing device 104 also includes a developing sleeve 24 as a developer carrying means and a trimming (chain-cutting) member 25 for regulating a magnetic brush chain formed of the developer carried on the developing sleeve 24, in the developing container 20.

The inside of the developing container 20 is horizontally divided by a partition wall 23 into a developing chamber 21*a* and a stirring chamber 21*b*. The partition wall 23 extends in the direction perpendicular to the drawing sheet of FIG. 4. The developer is stored in the developing chamber 21*a* and the stirring chamber 21*b*. In the developing chamber 21*a* and the stirring chamber 21*b*, first and second feeding screws 22*a* and 22*b* which are feeding members as developer stirring and feeding means are disposed, respectively. As shown in FIG. 5, the first feeding screw 22*a* is disposed, at the bottom portion of the developing chamber 21*a*, roughly in parallel to the axial direction of the developing sleeve 24. It conveys the developer in the developing chamber 21*a* in one direction along the axial direction of the developing sleeve 24 by being rotated. The second feeding screw 22*b* is disposed, at the bottom portion of the stirring chamber 21*b*, roughly in parallel to the first feeding screw 22*a*. It conveys the developer in the stirring chamber 21*b* in the direction opposite to that of the first feeding screw 22*a*.

Thus, by the feeding of the developer through the rotation of the first and second feeding screws 22*a* and 22*b*, the developer is circulated between the developing chamber 21*a* and the stirring member 21*b* through openings 26 and 27 (that is, communicating portions) present at both ends of the partition wall 23 (FIG. 5). In this embodiment, the developing chamber 21*a* and the stirring chamber 21*b* are horizontally disposed. However, the present invention is also applicable to a developing device in which the developing chamber 21*a* and the stirring chamber 21*b* are vertically disposed and developing devices of other types.

The developing container 20 is provided with an opening at a position corresponding to a developing region B wherein the developing container 20 opposes the photosensitive drum 101. At this opening, the developing sleeve 24 is rotatably disposed so as to be partially exposed toward the photosensitive drum 101. In this embodiment, the diameters of the developing sleeve 24 and the photosensitive drum 101 are 20 mm and 30 mm, respectively, and a distance in the closest area between the developing sleeve 24 and the photosensitive drum 101 is about 300 μm. By this constitution, development can be effected in a state in which the developer fed to the developing region B is brought into contact with the photosensitive drum 101.

Incidentally, the developing sleeve 24 is formed of nonmagnetic material such as aluminum and stainless steel and inside thereof a magnetic roller 24*m* as a magnetic field generating means is non-rotationally disposed.

In the constitution described above, the developing sleeve 24 is rotated in the direction indicated by an arrow (counterclockwise direction) to carry the two component developer regulated in its layer thickness by cutting of the chain of the magnetic brush with the trimming member 25. Then, the developing sleeve 24 conveys the layer thickness-regulated developer to the developing region B in which the developing sleeve 24 opposes the photosensitive drum 101, and supplies the developer to the electrostatic latent image formed on the photosensitive drum 101, thus developing the latent image. At this time, in order to improve development efficiency, i.e., a rate of the toner imparted to the latent image, a developing bias voltage in the form of a DC voltage biased or superposed with an AC voltage is applied to the developing sleeve 24 from a power (voltage) source. In this embodiment, the developing bias is a combination of a DC voltage of −500 V, and an AC voltage which is 1,800 V in peak-to-peak voltage Vpp and 12 kHz in frequency f. However, the DC voltage value and the AC voltage waveform are not limited to those described above.

In the two component magnetic brush developing method, generally, the application of AC voltage increases the development efficiency and therefore the image has a high quality but on the other hand, fog is liable to occur. For this reason, by providing a potential difference between the DC voltage applied to the developing sleeve 24 and the charge potential of the photosensitive drum 101 (i.e., a white background portion potential), the fog is prevented.

The trimming member (regulating blade) 25 is constituted by a nonmagnetic member formed with an aluminum plate or the like extending in the longitudinal axial direction of the developing sleeve 24. The trimming member 25 is disposed upstream of the photosensitive drum 101 with respect to the developing sleeve rotational direction. Both the toner and the carrier of the developer pass through the gap between a free end of the trimming member 25 and the developing sleeve 24 and are sent into the developing region B.

Incidentally, by adjusting the gap between the trimming member 25 and the surface of the developing sleeve 24, the trimming amount of the magnetic brush chain of the developer carried on the developing sleeve 24 is regulated, so that the amount of the developer sent into the developing region B is adjusted. In this embodiment, a coating amount per unit area of the developer on the developing sleeve 24 is regulated at 30 mg/cm$^2$ by the trimming member 25.

The gap between the trimming member 25 and the developing sleeve 24 is set at a value in the range of 200-1,000 μm, preferably, 300-700 μm. In this embodiment, the gap is set at 500 μm.

Further, in the developing region B, the developing sleeve 24 of the developing device 104 moves in the same direction as the movement direction of the photosensitive drum 101 at a peripheral speed ratio of 1.80 by which the developing sleeve 24 moves at the peripheral speed which is 1.80 times that of the photosensitive drum 101. With respect to the peripheral speed ratio, any value may be set as long as the set value is in the range of 0-3.0, preferably, 0.5-2.0. The greater the peripheral (moving) speed ratio, the higher the development efficiency. However, when the ratio is excessively large, problems such as toner scattering and developer deterioration occur. Therefore, the ratio is desired to be set in the above-mentioned range.

Further, at the opening (communicating portion) 26 in the developing container 20, as a temperature detecting means for the developer, a temperature sensor 104T is disposed. The disposition place of the temperature sensor 104T in the developing container 20 may desirably be a position in which a sensor surface is buried in the developer in order to improve detection accuracy.

Here, the temperature sensor 104T will be described more specifically with reference to FIG. 6. In this embodiment, as the temperature sensor 104T, a temperature/humidity sensor ("SHT1X series", mfd. by Sensirion Co., Ltd.) was used. The temperature sensor 104T includes a sensing element 1001 of an electrostatic capacity polymer as a humidity detecting device and includes a band gap temperature sensor 1002 as a temperature detecting device. The temperature sensor 104T is a CMOS device having such a specification that outputs of the sensing element 1001 and band gap temperature sensor 1002 are coupled by a 14 bit-A/D converter 1003 and serial output is performed through a digital interface 1004.

The band gap temperature sensor 1002 as the temperature detecting device uses a thermistor linearly changing in resistance value with respect to the temperature and calculates the temperature from the resistance value. Further, the sensing element 1001 as the humidity detecting device is a capacitor in which a polymer is inserted as a dielectric member. The sensing element 1001 detects the humidity by converting the electrostatic capacity into the humidity by utilizing such a property that the content of water which is adsorbed by the polymer is changed depending on the humidity and as a result, the electrostatic capacity of the capacitor linearly changes with respect to the humidity. The temperature sensor 104T used in this embodiment can detect both of the temperature and the humidity. However, actually, only a detection result of the temperature is utilized, so that the use of other sensors capable of detecting only the temperature may also be sufficient.

[Supply of Developer]

A supplying method of the developer in this embodiment will be described with reference to FIGS. 4 and 5. At an upper portion of the developing device 104, a toner supplying device 30 as a supplying means for supplying the toner to the developing device 104 depending on a consumption amount of the developer is provided. The toner supplying device 30 includes a hopper 31 accommodating a two-component developer for supply in which the toner and a carrier are mixed (ordinarily in a (toner/developer for supply) ratio of 100% to 80%). The hopper 31 includes a screw-shaped supplying member, i.e., a supplying screw 32 at a lower portion thereof, and an end of the supplying screw 32 extends to a position of a developer supplying opening 30A provided at a rear end portion of the developing device 104.

The toner in an amount corresponding to an amount of the toner consumed by the image formation is passed from the hopper 31 through the developer supplying opening 30A and is supplied into the developing device 104 by a rotational force of the supplying screw 32 and the force of gravitation of the developer. The amount of the developer for supply to be supplied from the hopper 31 into the developing device 104 is roughly determined by the number of rotation of the supplying screw 32. This number of rotation is determined by a CPU 206 (FIG. 3) as a control means on the basis of a video count value of the image data, a detection result of an unshown toner content (concentration) detecting means provided in the developing container 20, or the like.

Here, the two component developer, which comprises the toner and the carrier, stored in the developing container 20 will be described more specifically.

The toner contains primarily binder resin, and coloring agent. If necessary, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size. Further, as the toner in recent years, a toner having a low melting point or a toner having a low glass transition point Tg (e.g., ≤70° C.) is used in many cases in order to improve a fixing property. In some cases, in order to further improve the fixing property, a wax is incorporated in the toner. The developer in this embodiment contains a pulverization toner in which the wax is incorporated.

As for the material for the carrier, particles of iron, the surface of which has been oxidized or has not been oxidized, nickel, cobalt, manganese, chrome, rare-earth metals, alloys of these metals, and oxide ferrite are preferably usable. The method of producing these magnetic particles is not particularly limited. A weight-average particle size of the carrier may be in the range of 20-60 μm, preferably, 30-50 μm. The carrier may be not less than $10^7$ ohm·cm, preferably, not less than $10^8$ ohm·cm, in resistivity. In this embodiment, the carrier with a resistivity of $10^8$ ohm·cm was used.

Incidentally, the volume-average particle size of the toner used in this embodiment was measured by using the following device and method. As the measuring device, a sheath-flow electric resistance type particle size distribution measuring device ("SD-2000", manufactured by Sysmex Corp.) was used. The measuring method was as follows. To 100-150 ml of an electrolytic solution which is a 1%-aqueous NaCl solution prepared using reagent-grade sodium chloride, 0.1 ml of a surfactant as a dispersant, preferably, alkylbenzenesulfonic acid salt, was added, and to this mixture, 0.5-50 mg of a measurement sample was added.

Then, the electrolytic solution in which the sample was suspended was dispersed for about 1-3 minutes in an ultrasonic dispersing device. Then, the particle size distribution of the sample, the size of which is in the range of 2-40 μm was measured with the use of the above-mentioned measuring device ("SD-2000") fitted with a 100 μm aperture, and the volume-average distribution was obtained. Then, a volume-average particle size was obtained from the thus-obtained volume-average distribution.

Further, the resistivity of the carrier used in this embodiment was measured by using a sandwich type cell with a measurement electrode area of 4 $cm^2$ and a gap between two electrodes of 0.4 cm. A voltage E (V/cm) was applied between the two electrodes while applying 1 kg of weight (load) to one of the electrodes, to obtain the resistivity of the carrier from the amount of the current which flowed through the circuit.

[Forced Consumption Mode]

An operation in a forced consumption mode in this embodiment will be described with reference to FIGS. 7-13. First, in the image forming apparatus 100, in the case where an image having a low image formation ratio (print ratio), i.e., a low-duty image, is continuously formed, the operation in the forced consumption mode in which the toner is forcedly consumed is executable after the image formation is interrupted or during post-rotation with an end of an image forming job.

That is, in the case where the low-duty image is continued, the proportion of the toner transferred from the inside of the developing container 20 onto the photosensitive drum 101 becomes small. For this reason, the toner in the developing container 20 is subjected to stirring of the first and second feeding screws 22*a* and 22*b* and rubbing at the time of passing through the trimming member 25, for a long time. As a result, the above-described external additive for the toner comes off the toner or is buried in the toner surface, so that the flowability or charging property of the toner lowers and thus the image quality deteriorates. Therefore, in general, the operation in the forced consumption mode in which after the image formation is interrupted (downtime is provided) or during the post-rotation, the deteriorated toner in the developing device 104 is used for the development in a non-image region and thus is forcedly discharged (consumed) is executed.

Here, the image forming job is a series of operations performed as described below on the basis of a print instruction signal (image formation instruction signal). That is, the image forming job is a series of operations from start of a preparatory operation (so-called pre-rotation operation) required for effecting the image formation until a preparatory operation (so-called post-rotation operation) required for ending the image formation after an image forming step is performed. Specifically, the image forming job refers to the operations from the pre-rotation operation (preparatory operation before the image formation) after the print instruction signal is sent (the image forming job is inputted) to the post-rotation operation (operation after the image formation), and includes an image forming period and a sheet (paper) interval (non-image formation period). For example, in the case where an image forming job for 10 sheets of plain paper and 2 sheets of thick paper is inputted, operations from the pre-rotation operation to the post-rotation operation via image formation on 10 sheets of plain paper and 2 sheets of thick paper constitute one image forming job. However, the pre-rotation operation and the post-rotation operation can be omitted in the case where the image forming job is continuously inputted or in the case where a subsequent image forming job is inputted during execution of the image forming job. For example, the case where an image formation instruction including a first image forming job for 10 sheets of plain paper and 2 sheets of thick paper and a second image forming job for 5 coated paper is inputted will be considered. In this case, at least one of the post-rotation operation of the first image forming job and the pre-rotation operation of the second image forming job may be omitted.

[Setting of Toner Deterioration Threshold]

First, setting of a toner deterioration threshold as a reference value which is used for executing the operation in the forced consumption mode and which is set for a predetermined unit of image formation will be described. The predetermined unit of image formation is a unit, set for effecting the image formation, such as a single A4-sized recording material. The predetermined unit is not limited thereto, but may also be any size such as A3 or B5, and may also be appropriately set depending on the size or status of use, such as ½ sheet or plural sheets, principally used in the image forming apparatus. In this embodiment, one sheet of the A4-sized recording material is used as the predetermined unit (of image formation).

As described above, in the case where the proportion of the toner transferred onto the photosensitive drum is small and the amount of the toner supplied into the developing container 20 is small, i.e., in the case where the print ratio is low, the toner deterioration has gone. As a value (the reference value described above) indicating that a lowering in image quality due to the toner deterioration generates when the print ratio is low to what extent, in this embodiment, a "toner deterioration threshold video count Vt" is set.

The toner deterioration threshold video count Vt can be calculated by an experiment described below. For example, in this embodiment, continuous one-side-image formation on 1,000 A4-sized sheets was effected while changing the print ratio (from 0% to 5%) for each of the colors, so that a change in image quality before and after the continuous image formation is surveyed. A result of this experiment is shown in a table of FIG. 7. In FIG. 7, "o" represents that the image quality deterioration did not occur, and "x" represents that the image quality deterioration occurs in terms of at least one of lowering in degree of fog, toner scattering, and graininess.

Accordingly, from FIG. 7, in this embodiment, the image deterioration due to the toner deterioration generates when the print ratio for the associated color is lower than 1% for yellow (Y), 2% for magenta (M), 1% for cyan (C) and 2% for black (K). Further, the video count of a whole surface solid image (image having the print ratio of 100%) on one surface (side) of the A4-sized sheet for a certain color is 512 in this embodiment. In this embodiment, the video count corresponds to a consumption value depending on an amount of the toner consumed every predetermined unit of image formation. From the above, the toner deterioration threshold video count Vt in this embodiment is Vt(Y)=5, Vt(M)=10, Vt(C)=5 and Vt(K)=10. In calculation of the toner deterioration threshold video count Vt, the fractional portion thereof was round off to the closest whole number. Further, the toner deterioration threshold video count Vt varies depending on the material or the like of the developer (the toner and the carrier), and therefore may be appropriately calculated and set.

[Discrimination as to Whether or not Operation in Forced Consumption Mode in Comparison Example can be Executed]

Next, discrimination as to whether or not the operation in the forced consumption mode in Comparison Example can be executed will be described with reference to FIG. 8. As a precondition, a concept of the operation in the forced consumption mode for each of the colors is the same. Therefore, the colors are omitted from description in the following flowcharts and the like in some cases, but in that cases, common control is effected for each of the colors. In Comparison Example, as an easy-to-understand example, the case where such an image that the print ratios per (one) sheet for the colors of Y, M, C and K are 5% for Y, 5% for M, 5% for C and 1% for K (hereinafter, this image is referred to as a "low-duty-black image chart") is continuously formed on A4-sized sheets is considered.

When the image formation is started, the presence or absence of a discharge execution flag is checked (S1). Here, the discharge execution flag refers to a predetermined signal stored in RAM 211 (FIG. 3) as a storing means in the case where a predetermined condition for executing the operation in the forced consumption mode described later. If the discharge execution flag is not set, i.e., if the predetermined signal is not stored in the RAM 211, the video signal count portion 207 shown in FIG. 3 calculates video counts V(K), V(M), V(C) and V(K) for the respective colors. That is, the above-described consumption amount is calculated (S2). In this embodiment, the video count of the whole (entire) surface solid image (the image with the print ratio of 100%) on one surface (side) of A4-sized sheet for a certain color is 512. The video counts of the "low-duty-black image chart" are V(Y)=26, V(M)=26, V(C)=26 and V(K)=15. Here, when each video count is calculated, the fractional portion of the number is rounded off to the nearest integer.

Then, the toner deterioration threshold video count Vt is calculated from the table of the toner deterioration threshold video count Vt, shown in FIG. 7, stored in the RAM 211 in FIG. 3 (S3). That is, the reference value set for the predetermined unit is calculated. From FIG. 7, the toner deterioration threshold video count Vt for Y and C is 5, and the toner deterioration threshold video count Vt for M and K is 10. The toner deterioration threshold video count Vt represents a threshold at which the image quality can be maintained, and shows that the toner deterioration goes when the image having the print ratio and the video count smaller than Vt is outputted.

Then, the above-described difference between the video count V and the toner deterioration threshold video count Vt, i.e., Vt−V is calculated (S4). That is, the CPU 206 also as a difference calculating means calculates the difference (Vt−V) by subtracting the video count v (consumption amount) from the toner deterioration threshold video count Vt (reference value). This difference is a deterioration information determined on the basis of the consumption value and the reference value. The CPU 206 also as an integrating means adds (integrates) the difference (Vt−V) to a toner deterioration integrated value X which is an integrated value, irrespective of the sign (positive or negative) of the value of (Vt−V) (S5). The toner deterioration integrated value X is an index indicating a current toner deterioration state, and is the integrated value of the video count value calculated by (Vt−V). Accordingly, in the case where use of the developing device is started from an unused state (when the developer is a new developer (e.g., immediately after exchange of the developing device)), the toner deterioration integrated value X is zero.

When the above step S5 is specifically described, e.g., in the case where the print ratio is low, the value of V is small, so that the value of (Vt−V) is a positive value. By adding the above-calculated positive value of (Vt−V) to the toner deterioration integrated value X, the resultant value represents a state in which the toner deterioration goes. On the other hand, e.g., in the case where the print ratio is high, the value of V is large, so that the value of (Vt−V) is a negative value. By adding the above-calculated negative value of (Vt−V) to the toner deterioration integrated value X, the resultant value represents a state in which the toner is recovered from the toner deterioration state. That is, the value represents the state in which the toner is recovered from the toner deterioration state by newly supplying the toner by supply control after the toner is consumed at the high print ratio.

Then, the CPU 206 also as a control means discriminates the sign (positive or negative) of the latest toner deterioration integrated value X calculated in the step S5 (S6). Then, in the case where the toner deterioration integrated value X is a negative value, the toner deterioration integrated value X is reset to zero (S7). That is, in this case, a state in which the toner deterioration is reset by the consumption of the high print ratio toner and then by supply of the (new) toner is formed. Accordingly, the toner deterioration integrated value X is reset to zero, and subsequently image formation is executed (returned to S1).

On the other hand, in the case where the toner deterioration integrated value X is a positive value, with respect to the toner deterioration integrated value X calculated and updated every image formation in the above steps, the CPU 206 calculates a difference (A−X) of the toner deterioration integrated value X from a discharge execution threshold A which is a predetermined threshold (S8). Here, the discharge execution threshold A is a predetermined threshold value which is arbitrarily settable. The smaller the discharge execution threshold A, the higher the frequency of execution of the operation in the forced consumption mode (toner discharging operation) even in the continuous image formation at the same print ratio. The discharge execution threshold A is set at 512 in this embodiment. When the set value of the discharge execution threshold A is excessively large, a time in which the toner deterioration goes until the operation in the forced consumption mode is performed is long, so that it is desirable that the set value is approximately equal to the video count value of the whole surface solid image (the image with the print ratio of 100%) on one surface of A4-sized sheet to A3-sized sheet. Further, e.g., with a larger volume of the developer which can be retained in the developing container 20, there is a tendency that the toner discharge execution threshold A can be set at a larger value.

Then, the CPU 206 also as an executing means discriminates the sign (positive or negative) of the difference (A−X), calculated in the step S8, between the toner deterioration integrated value X and the discharge execution value A (S9). In the case where the difference (A−X) is positive or zero, i.e., in the case where the toner deterioration integrated value X (integrated value) is not more than the discharge execution threshold A (i.e., not more than the predetermined threshold), the operation in the forced consumption mode is not executed (S10). That is, in this case, the toner deterioration does not go to the extent that the operation in the forced consumption mode is required to be executed immediately, and therefore the operation in the forced consumption mode is not executed and subsequently the image formation is executed. At this time, the toner deterioration integrated value X is continuously used as it is. That is, to the toner deterioration integrated value X at that time, a subsequent difference (Vt−V) is added (integrated).

On the other hand, in the case where the difference (A−X) is negative, i.e., in the case where the toner deterioration integrated value X (integrated value) is larger than the discharge execution value A (predetermined threshold), the predetermined signal is stored in the RAM 211, i.e., the discharge effect is set (S11). That is, in this case, the toner deterioration sufficiently goes, and therefore the discharge execution flag is set after executing the operation in the forced consumption mode. Then, the CPU 206 discriminates whether or not the timing is execution timing of the operation in the forced consumption mode (S12). That is, even when the discharge execution flag is set, in some cases, execution of the operation in the forced consumption mode (toner discharging operation) after the image formation is interrupted cannot be made immediately.

For example, assuming that the toner deterioration in the developing device 104K for K goes and the toner deterioration-integrated value X is larger than the execution threshold A, i.e., A−X<0 is satisfied and the discharge execution flag is set, when the image at the time when the discharge execution flag is set is final image, the operation in the forced consumption mode is executable as it is. However, in the case where the continuous image formation is in progress, when the discharge execution flag for the developing device 104K for K is set, at the image forming station Y for Y, a subsequent image forming operation has already been continued. For this reason, in order to prevent the Y toner with which the image formation is started from being useless, the image formation cannot be interrupted immediately, and therefore even after the discharge execution flag for K is set, the image formation is effected also with respect to a subsequent image which has already been subjected to the image formation. Accordingly, even when the discharge execution flag is set, a time lag generates in some cases until the operation in the forced consumption mode is executed. In Comparison Example, it is assumed that there is a time lag correspond to image formation on two sheets from the setting of the developing discharge execution flag to the execution of the operation in the forced consumption mode.

For this reason, in the step S12, whether or not the timing is timing (predetermined timing) when the operation in the forced consumption mode is executable is checked, and if the timing is the predetermined timing, the image formation is interrupted and then the operation in the forced consumption mode is executed (S13). The operation in the forced consumption mode will be described later. When the operation in the forced consumption mode is executed in the step S13, the toner deterioration-integrated value X is reset to zero (S14), and then the image formation is resumed (S15).

On the other hand, if the timing is not the predetermined timing when the operation in the forced consumption mode is executable in the step S12, the operation in the forced consumption mode is not executed, and the image formation is continued while maintaining the toner deterioration-integrated value S as it is (S10). In subsequent image formation, the discharge execution flag has already been set, and therefore in the step S1, a separate flow is made, and the image formation is continued until predetermined timing. At this time, until the predetermined timing, the toner deterioration-integrated value is not updated (renewed) irrespective of the image ratio.

[Operation in Forced Consumption Mode]

The operation in the forced consumption mode will be described with reference to FIG. 9. In the above-described step S12 of FIG. 8, in the case where the timing is the predetermined timing when the operation in the forced consumption mode is executable, the operation in the forced consumption mode is executed after the image formation is interrupted or during the post-rotation. First, to the primary transfer roller 105 (FIGS. 1 and 2), a primary transfer bias of an opposite polarity to that during the normal image formation (i.e., the transfer bias of an identical polarity to the charge polarity of the toner image on the photosensitive drum 101) is applied (S21). Next, the toner in the amount corresponding to the video count equivalent to the discharge execution threshold A is discharged onto the photosensitive drum 101 (S22). In Comparison Example, the discharge execution threshold A is set at 512 (corresponding to the video count of the image of the whole surface solid print ratio of 100%) on the surface of A4-sized recording material, so that an operation of discharging the whole surface solid image formed on one surface of the A4-sized recording material is executed. Further, the latent image, on the photosensitive drum 101, for the toner discharging may desirably be the whole surface solid image with respect to the longitudinal direction (rotational axis direction) of the photosensitive drum 101 in order to minimize the downtime generated by the discharging.

Then, the toner discharged on the photosensitive drum 101 is not transferred onto the intermediary transfer belt since the primary transfer bias has the same polarity as that of the toner, and is collected by a photosensitive drum cleaner 109 (S23). Finally, the primary transfer bias is returned to that of the polarity during the normal image formation (S24), the operation in the forced consumption mode is ended and the normal image forming operation is resumed.

In the controller of the above-described operation in the forced consumption mode in Comparison Example, the following case will be considered. That is, the case where the "low-duty-black image chart" is formed on 104 sheets, and then the high-duty-black image chart" is formed on one sheet, i.e., continuous image formation on 106 sheets in total is effected will be considered specifically. Incidentally, as described above, the "low-duty-black image chart" is a chart such that the image of Y=5%, M=5%, C=5% and K=1% is formed on one surface of the A4-sized recording material. Further, the "high-duty-black image chart" is a chart such that the image is Y=5%, M=5%, C=5% and K=100% is formed on one surface of the A4-sized recording material.

First, in the case where each of the "low-duty-black image chart" and the "high-duty-black image chart" is formed on one surface of each of A4-sized sheets, how to add (integrate) the toner deterioration integrated value X for each color in the operation in the forced consumption mode is shown in FIG. 10. As shown in FIG. 10, in the image formation of the "low-duty-black image chart", with respect to Y (yellow), M (magenta) and C (cyan), the print ratio is always sufficiently high and therefore a value to be added to the toner deterioration integrated value is the negative value. On the other hand, with respect to K (black), the print ratio is low, and therefore the value to be added to the toner deterioration integrated value X is a positive value of +5. Accordingly, when the "low-duty-black image chart" is printed, the toner deterioration for K (black) goes little by little.

Further, in the image formation of the "high-duty-black", with respect to the Y (yellow), M (magenta) and C (cyan), the print ratio is sufficiently high, and therefore the value to be added to the toner deterioration integrated value X is the negative value. On the other hand, with respect to K (black), the print ratio is very high, and therefore the value to be added to the toner deterioration integrated value X is a negative value. On the other hand, with respect to K (black), the print ratio is very high, and therefore the value to be added to the toner deterioration integrated value X is a large negative value of −502. Accordingly, when the "high-duty-black image chart" is printed, the toner is abruptly recovered from the toner deterioration state for K (black).

Here, the above-described case will be described. With respect to Y (yellow), M (magenta) and C (cyan), as shown in FIG. 10, the value added to the toner deterioration integrated value X is always the negative value. For this reason, as shown in the steps S6 and S7 in FIG. 8, the toner deterioration integrated value X is always in the state in which the toner deterioration integrated value X is reset to zero. For this reason, progression for K (black) will be described with reference to FIG. 11.

Figure 11:
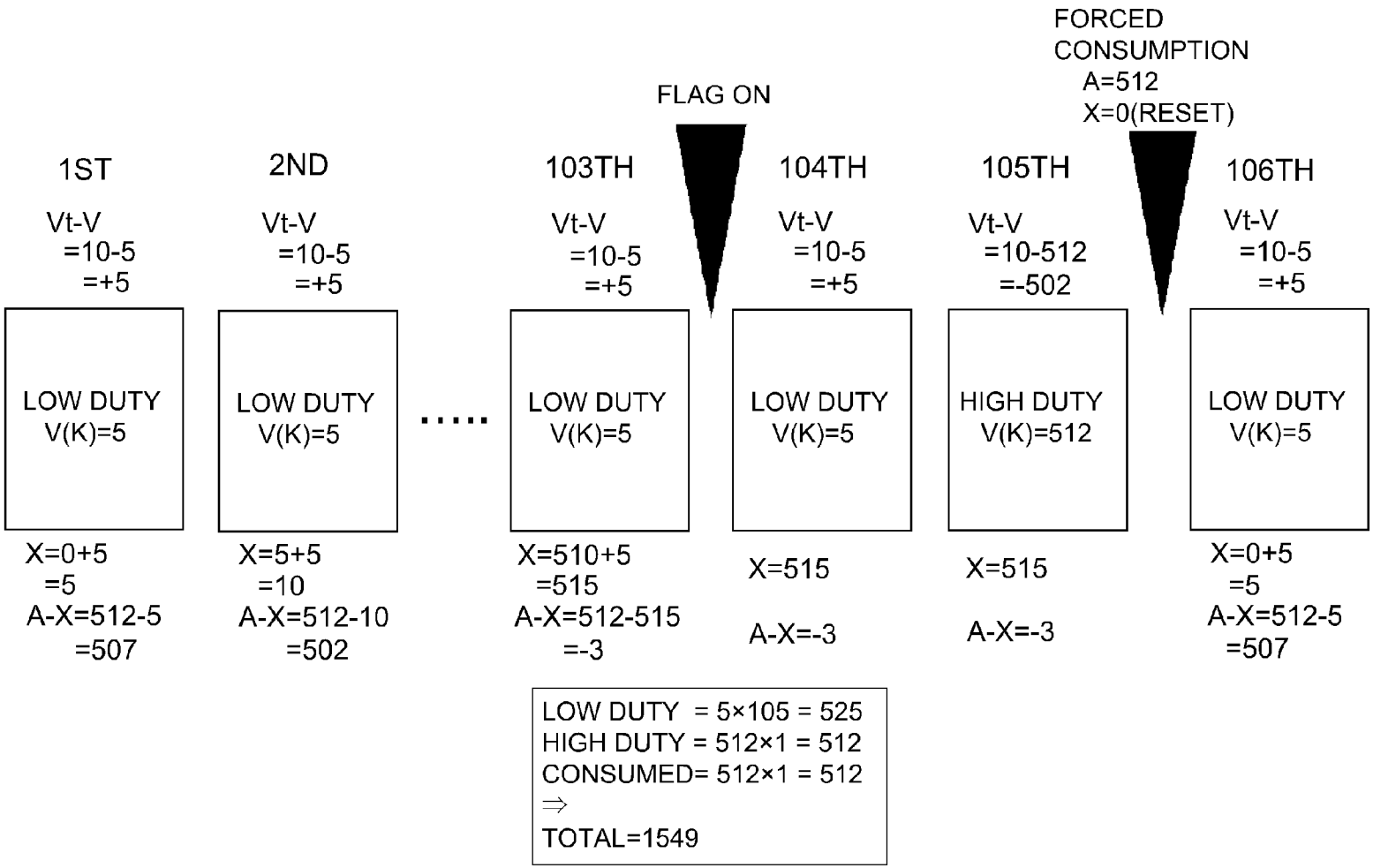
FIG. 11 is a schematic view showing a relationship among parameters in the case where an image of the low-duty-black is continuously formed in Comparison Example.

As described above, during printing of the "low-duty-black image chart", the toner deterioration integrated value X is gradually integrated by +5. Accordingly, as shown in FIG. 11, from the first sheet to the 103-th sheet, the toner deterioration integrated value X is integrated and monotonically increased in the order of 5, 10, 15 . . . 515. Further, the value of the difference (A−X) between the toner discharge execution threshold A (=512) and the toner deterioration integrated value X is monotonically decreased, from the first sheet to the 102-th sheet in the order of 507, 502, 497 . . . 2, and at the 103-th sheet, the difference (A−X) is −3 which is the negative.

Figure 8:
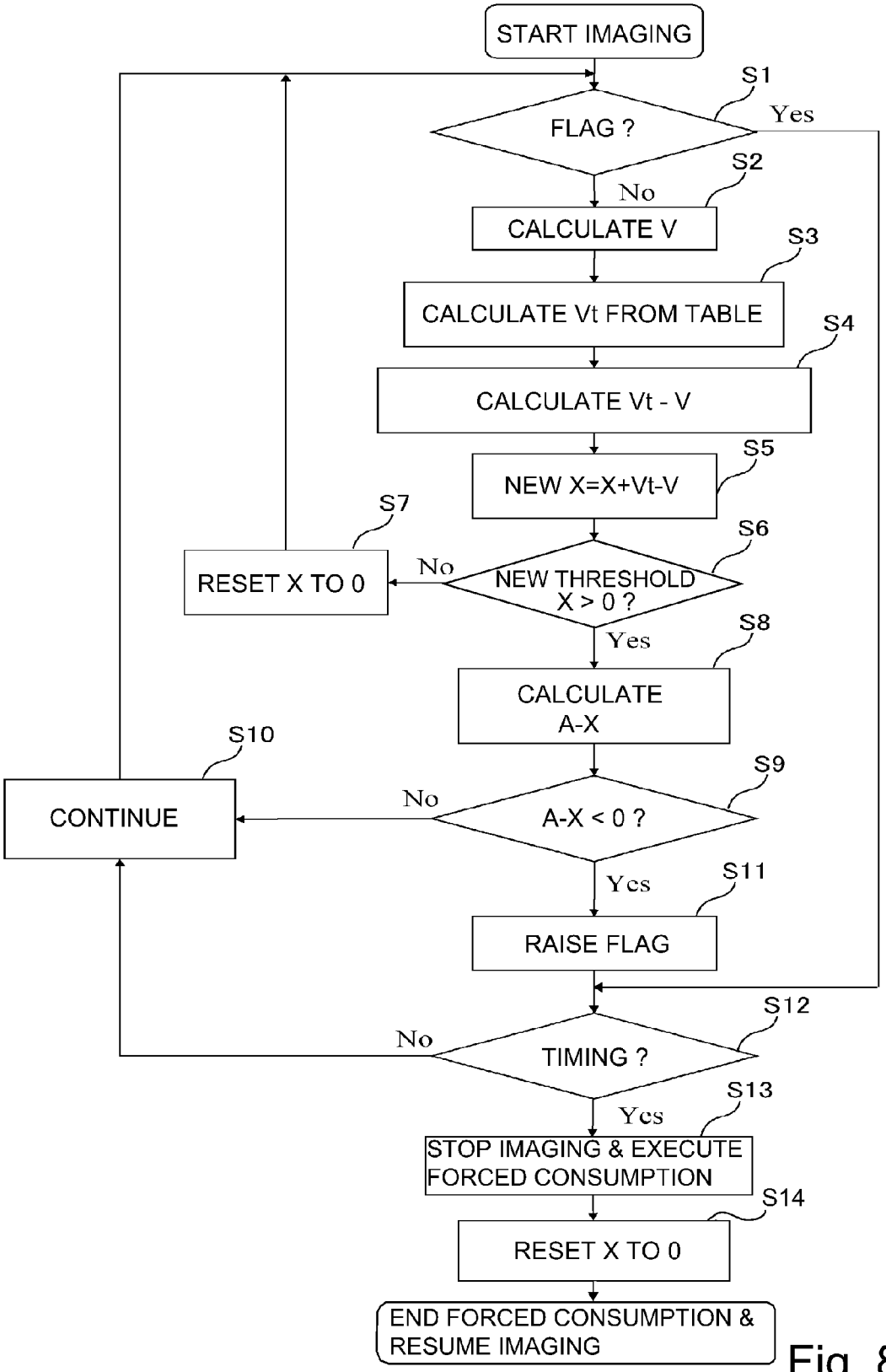
FIG. 8 is a flowchart for discriminating whether or not an operation in a forced consumption mode in Comparison Example can be executed.
Figure 9:
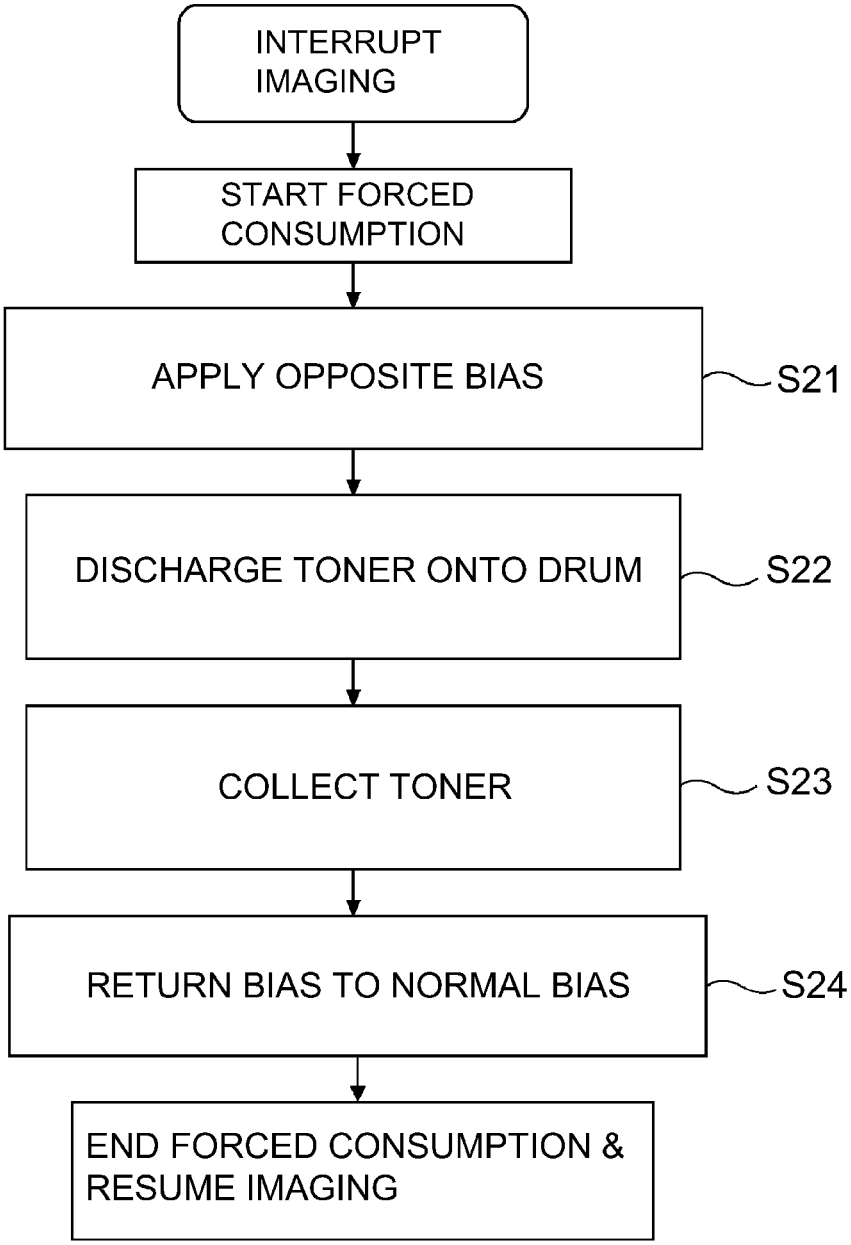
FIG. 9 is a flowchart showing an operation in the forced consumption mode in Comparison Example and in the embodiment.

In this case, in accordance with the flowchart of FIG. 8, the discharge execution flag is set. However, as described above, in a period from the setting of the discharge execution flag to the execution of the discharging operation in actuality, there is a time lag corresponding to the 2 sheets. Accordingly, after the image formation of the "high-duty-black image chart" on the 105-th sheet is ended, the operation in the forced consumption mode is executed din actuality (i.e., the toner deterioration-integrated value X is not updated from the 104-th sheet to the 105-th sheet).

That is, the image formation is interrupted after the end of the image formation on the 105-th sheet, and then the operation in the forced consumption mode is executed, so that the forced consumption of the toner in an amount corresponding to A=512 is executed. After the operation in the forced consumption mode is executed, the toner deterioration integrated value X is reset to, and the image formation is resumed. Finally, when the "low-duty-black image chart" is printed on the 106-th sheet, the toner deterioration integrated value X is 5, so that the difference (A−X) is 507.

From the above, with respect to K (black), a total toner consumption amount by the image formation on 106 sheets in the case where the operation in the forced consumption mode in Comparison Example is performed will be estimated. Then, the respective video counts are 5×105=525 for 105 sheets of the "low-duty-black image chart", 512×1=512 for one sheet of the "high-duty-black image chart", and 512 for once of the forced toner consumption. As a result, in the operation in Comparison Example, the toner in the amount corresponding to the video count of 1549 in total is consumed.

[Discrimination as to Whether or not Operation in Forced Consumption Mode in this Embodiment can be Executed]

Next, discrimination as to whether or not the operation in the forced consumption mode in this embodiment can be executed will be described with reference to FIG. 12. Also in this embodiment, similarly as in Comparison Example, as a precondition, a concept of the operation in the forced consumption mode for each of the colors is the same. Therefore, the colors are omitted from description in the following flow-charts and the like in some cases, but in that cases, common control is effected for each of the colors. Also in this embodiment, as an easy-to-understand example, the case where such an image that the print ratios per (one) sheet for the colors of Y, M, C and K are 5% for Y, 5% for M, 5% for C and 1% for K ("low-duty-black image chart") is continuously formed on A4-sized sheets will be considered.

Figure 12:
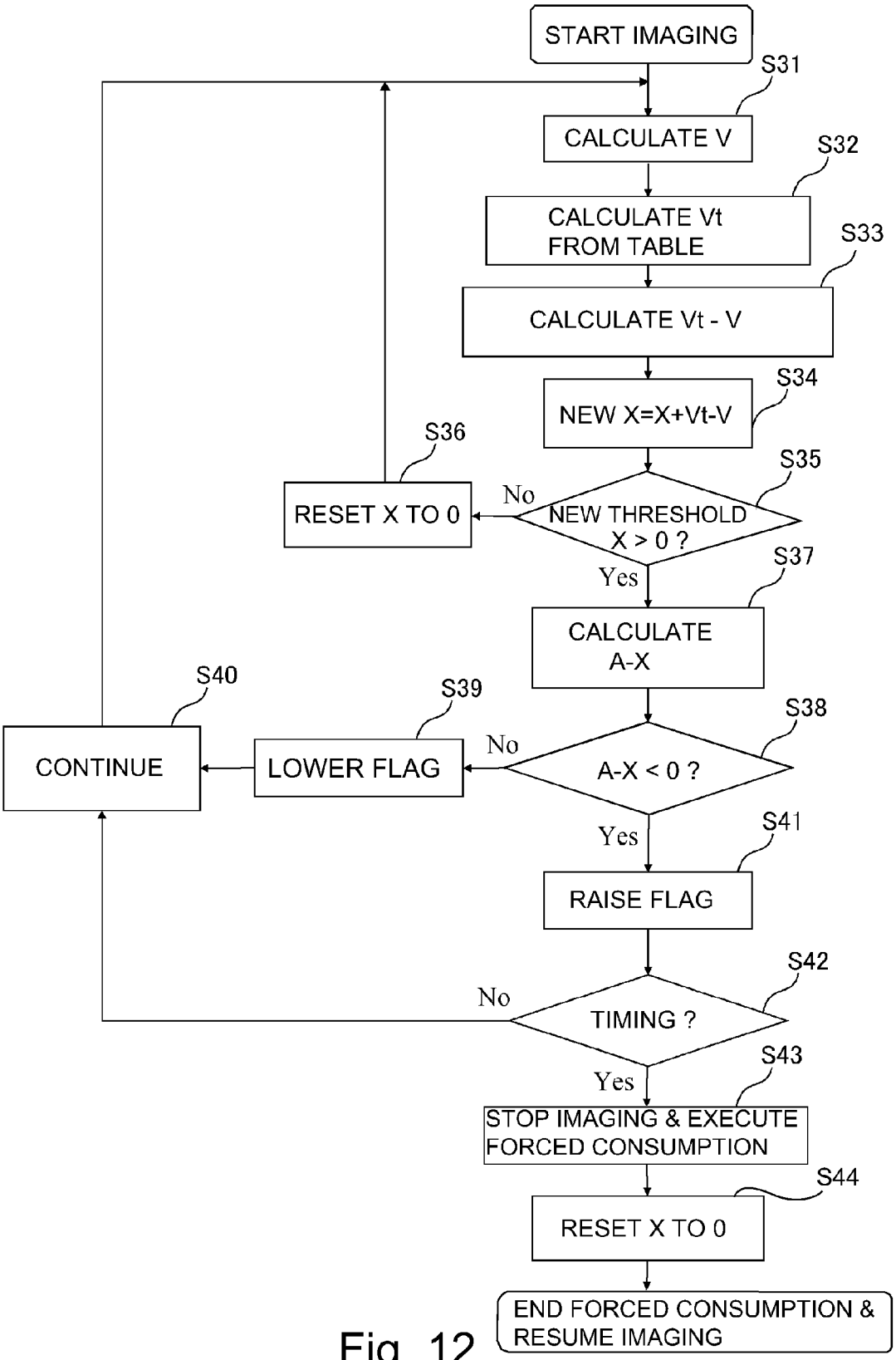
FIG. 12 is a flowchart showing for discriminating whether or not an operation in the forced consumption mode in the embodiment can be executed.

A difference between FIG. 8 (Comparison Example) and FIG. 12 (this embodiment) is that in the flowchart of FIG. 12, there is no step corresponding to S1 in FIG. 8 but a step S39 which is not employed in FIG. 8 is added. Other steps in FIG. 12 are similar to those in FIG. 8. Specifically, S31 to S38 in FIG. 12 correspond to S2 to S9 in FIG. 8, respectively, and S40 to S44 in FIG. 12 correspond to S10 to S14 in FIG. 8, respectively. For this reason, description of overlapping steps with those in FIG. 8 will be omitted or simplified, and in the following, the difference from FIG. 8 will be principally described.

First, when the image formation is started, the video signal count portion 207 calculates, as described above with reference to FIG. 3, video counts V(Y), V(M), V(C) and V(K) for the respective colors (S31).

Then, the toner deterioration threshold video count Vt is calculated from the table (FIG. 7) of the toner deterioration threshold video count Vt obtained by the above-described experiment or the like (S32). Then, the above-described difference between the video count V and the toner deterioration threshold video count Vt, i.e., (Vt−V) is calculated (S33). Then, to the toner deterioration-integrated value X, (Vt−V) is added (S34). Then, the sign (positive or negative) of the latest toner deterioration integrated value X calculated in the step S34 is discriminated (S35). In the case where the toner deterioration integrated value X is a negative value, this state shows a state in which the toner deterioration is reset by the consumption of the high print ratio toner and then by supply of the (new) toner. Accordingly, the toner deterioration integrated value X is reset to zero, and subsequently image formation is executed (S36).

On the other hand, in the case where the toner deterioration integrated value X is a positive value, with respect to the toner deterioration integrated value X calculated and updated every image formation in the above steps, the difference (A−X) of the toner deterioration integrated value X from the discharge execution threshold A is calculated (S37).

Then, the CPU 206 also as the executing means discriminates the sign (positive or negative) of the difference (A−X), calculated in the step S37, between the toner deterioration integrated value X and the discharge execution value A (S38). In the case where the difference (A−X) is negative, i.e., in the case where the toner deterioration integrated value X (integrated value) is more than the discharge execution threshold A (i.e., more than the predetermined threshold), a predetermined signal stored in the RAM 211, i.e., the discharge execution flag is set (S41). In other words, this case in the case where the toner deterioration sufficiently goes, and therefore a predetermined condition for executing the operation in the forced consumption mode is satisfied. Accordingly, the CPU 206 also as the discharging means discriminates whether or not the predetermined condition is satisfied, i.e., the toner deterioration-integrated value X (integrated value) is larger than the discharge execution threshold A (predetermined threshold). Then, in the case where the CPU 206 discriminates that the predetermined condition is satisfied, i.e., in the case where the difference (A−X) is negative, the discharge execution flag is set.

Then, the CPU 206 discriminates whether or not the timing is predetermined timing when the operation in the forced consumption mode is executable (S42). That is, similarly as in Comparison Example, even when the discharge execution flag is set, in some cases, the operation in the forced consumption mode (toner discharging operation) after the image formation is interrupted cannot be executed immediately.

For example, in the case where the continuous image formation is in progress, when the discharge execution flag for the developing device 104K for K is set, at the image forming station Y for Y, a subsequent image forming operation has already been continued in some cases. For this reason, even after the discharge execution flag for K is set, a time lag generates in some cases until the operation in the forced consumption mode is executed.

In the case of this embodiment, the video count is notified substantially simultaneously with timing of formation of the latent image for each color. Accordingly, the time lag is determined depending on how many sheets of the recording material enter a distance D from an exposure position (Y exposure position) on the photosensitive drum 101Y at the image forming station Y to an exposure position (K exposure position) on the photosensitive drum 101K at the image forming station K. Here, the distance D from the Y exposure position to the K exposure position is the sum of the following distances D1 to D3. D1 is a distance on the photosensitive drum 101Y from the Y exposure position to the primary transfer position (Y primary transfer position) on the photosensitive drum 101Y. D2 is a distance on the intermediary transfer belt 121 from the Y primary transfer position to the primary transfer position (K primary transfer position) on the photosensitive drum 101K. D3 is a distance on the photosensitive drum 101K from the K primary transfer position to the K exposure position. Then, in this distance D, depending on how may sheets of the recording material are subjected to the image formation, a maximum time lag generating from the setting of the discharge execution flag until the operation in the forced consumption mode is actually executed is determined. Accordingly, the predetermined timing when the operation in the forced consumption mode is executable is immediately after image formation on a predetermined number of sheets corresponding to a size of the recording material to be subjected to the image formation is effected after the discharge execution flag is set.

For example, in the case of this embodiment, at each of the image forming stations, the distance on the photosensitive drum from the exposure position to the primary transfer position is 45 mm, i.e., the same, and therefore D1 and D3 are 45 mm. Further, the distance D2 between the Y primary transfer position and the K primary transfer position is 285 mm. Accordingly, the distance D from the Y exposure position to the K exposure position is 375 mm. Here, in the case where the image formation on the A4-sized recording material (feeding direction length: 210 mm) is effected, when the discharge execution flag for the developing device 104K is set, the image formation on the first sheet is ended and the image formation on the second sheet has already been effected partway at the image forming station Y. Accordingly, in order to prevent the Y toner or the like with which the image formation is started from being useless, the video count for K is notified and not only the discharge execution flag is set but also the image formation of the associated image is completed. Then, after the image formation on at least 2 sheets is completed, the operation in the forced consumption mode is executed. That is, in this embodiment, in a period from the setting of the discharge execution flag until the operation in the forced consumption mode is executed, there is a time lag corresponding to the image formation on 2 sheets of the A4-sized recording material. Accordingly, in the case where the continuous image formation on the A4-sized recording material is effected, the operation in the forced consumption mode is executed immediately after the image formation on 2 sheets (predetermined corresponding number of sheets) after the discharge execution flag for the developing device 104K is set.

Similarly, in the case where the image is formed on the A3-sized recording material (feeding direction length: 420 mm), when the discharge execution flag for the developing device 104K is set, the image forming station Y has already effected subsequent image formation partway. Accordingly, the video count for K is notified, and not only the discharge execution flag is set but also the image formation of the associated image is completed. Then, image formation on at least one sheet is completed and thereafter the operation in the forced consumption mode is executed. That is, in this embodiment, in a period from the setting of the discharge execution flag until the operation in the forced consumption mode is executed, there is a time lag corresponding to image formation on one sheet of the A3-sized recording material. Accordingly, in the case where the continuous image formation on the A3-sized recording material is effected, after the discharge execution flag for the developing device 104K is set, the operation in the forced consumption mode is executed immediately after the image formation on one sheet (predetermined corresponding number of sheet). Similarly, in the case of an image (sheet) size smaller than the A4 size, in a period from the setting of the discharge execution flag until the operation in the forced consumption mode is executed in actuality, the number of sheets subjected to the image formation increases.

However, a condition (predetermined timing) of the time lag from the setting of the discharge execution flag until the operation in the forced consumption mode is executed is not limited thereto. In the case where there is a constraint of communication between an image processing controller and an engine controller or there is another constraint that the recording material passes through the secondary transfer position, where the toner image is transferred from the intermediary transfer belt 121, with reliability and then the operation in the forced consumption mode is executed, the time lag condition is in accordance with these constraints. Further, in the case where the discharge execution flag for the developing device for the color other than K, the time lag varies depending on the position of the execution flag. That is, the time lag becomes smaller with the position of the image forming station closer to an upstream with respect to the rotational direction of the intermediary transfer belt 12. Accordingly, depending on the image forming station for which the discharge execution flag is set, the predetermined timing may also be changed or made uniformly the same.

In the step S42, if the timing is timing (predetermined timing) when the operation in the forced consumption mode is executable, the image formation is interrupted and then the operation in the forced consumption mode is executed (S43). The operation in the forced consumption mode is similar to that described above with reference to FIG. 9. When the operation in the forced consumption mode is executed in the step S43, the toner deterioration-integrated value X is reset to zero (S44), and then the image formation is resumed.

On the other hand, if the timing is not the predetermined timing when the operation in the forced consumption mode is executable in the step S42, the operation in the forced consumption mode is not executed, and the image formation is continued while maintaining the toner deterioration-integrated value X as it is (S40). Then, in subsequent image formation, S31 to S42 are repeated. In the subsequent image formation, an image having a high image formation ratio (print ratio) is formed in some cases in a period from the setting of the discharge execution flag to the predetermined timing when the operation in the forced consumption mode is executable. In such a case, there is a possibility that (A−X) becomes positive or zero in S38. That is, in some cases, in a period from storing of the predetermined signal in the RAM 211 (after the toner deterioration-integrated value X exceeds the discharge execution threshold A) to the predetermined timing, the toner deterioration-integrated value X (integrated value) is not more than the discharge execution threshold A (predetermined threshold). In other words, in some cases, in a period from after the predetermined condition for executing the operation in the forced consumption mode is satisfied to the predetermined timing, the predetermined condition is not satisfied by subsequent image formation. In such a case, the CPU 206 also as a canceling means cancels the predetermined signal stored in the RAM 211, i.e., resets the discharge execution flag (S39).

Subsequently, the image formation is executed without executing the operation in the forced consumption mode (S40). In other words, the execution of the operation in the forced consumption mode at the predetermined timing is stopped. At this time, the toner deterioration-integrated value x maintained as it is. That is, to the toner deterioration-integrated value X at that time, a subsequent difference (Vt−V) is integrated (added).

On the other hand, in the subsequent image formation, in the case where an image having a low image formation ratio (print ratio) is formed in a period from the setting of the discharge execution flag to the predetermined timing when the operation in the forced consumption mode is executable, (A−X) is still negative in S38. Accordingly, the discharge execution flag is still set as it is. Then, in the case where the timing is the predetermined timing when the operation in the forced consumption mode is executable in S42, the image formation is once interrupted and then the operation in the forced consumption mode is executed (S43). That is, the CPU 206 also as an executing means executes the operation in the forced consumption mode at the predetermined timing when the operation in the forced consumption mode is executable in the case where the predetermined signal is stored in the RAM 211 (in the case where the discharge execution flag is set).

At this time, a discharge amount of the toner discharged in the operation in the forced consumption mode is a toner amount corresponding to A=512. That is, in this embodiment, the discharge execution threshold A is set at 512 (corresponding to the video count of the image of the whole surface solid print ratio of 100%) on the surface of A4-sized recording material, so that an operation of discharging the whole surface solid image formed on one surface of the A4-sized recording material is executed. That is, the toner in the amount corresponding to the discharge execution threshold A (predetermined threshold) is consumed in the operation in the forced consumption mode. Further, the latent image, on the photosensitive drum 101, for the toner discharging may desirably be the whole surface solid image with respect to the longitudinal direction (rotational axis direction) of the photosensitive drum 101 in order to minimize the downtime generated by the discharging.

Incidentally, the amount (discharge amount) of the toner consumed in the operation in the forced consumption mode may also be determined depending on the toner deterioration-integrated value X integrated after the predetermined signal is stored in the RAM 211 (after the discharge execution flag is set). For example, the toner may also be forcedly consumed in an amount (A+(X−A)) obtained by adding a toner amount corresponding to (X−A) to the toner amount corresponding to A=512. In summary, the toner may also be discharged in an amount obtained by adding a toner amount corresponding to an amount of the toner deteriorated in the period from the setting of the discharge execution flag until the operation in the forced consumption mode is executed. As a result, even when there is a time lag in the period from the setting of the discharge execution flag until the operation in the forced consumption mode is executed, the toner deterioration state can be preferably recovered to a normal state. After the execution of the operation in the forced consumption mode, the toner deterioration-integrated value X is rest to zero (S44), and then the image formation is resumed.

In this embodiment, the predetermined timing when the operation in the forced consumption mode is executable is set at timing immediately after the image formation on the predetermined number of sheets depending on the size of the recording material, e.g., 2 sheets of the A4-sized recording material, after the discharge execution flag is set. However, in the case where this predetermined timing is during the image formation on final several sheets in the image forming job, even when final image formation is effected without executing the operation in the forced consumption mode after the image formation is intendedly interrupted, the influence thereof on the image quality is little in some cases. Accordingly, in such a case, after the final image formation is ended, the operation in the forced consumption mode may also be executed. That is, the number of sheets from the setting of the discharge execution flag until the final image in the image forming job is formed and the number of sheets from the setting of the discharge execution flag to the predetermined timing are compared with each other, and then the predetermined timing when the operation in the forced consumption mode is executed in actuality may also be adjusted.

In other words, the predetermined timing is immediately after the final image in the image forming job is formed in the case where the number of sheets from the setting of the discharge execution flag to the end of the image forming job is more than a predetermined corresponding number and is not more than a certain number. Here, the predetermined corresponding number is, e.g., 2 sheets of the A4-sized recording material as described above, and the certain number is a value set so as to be larger than the predetermined corresponding number and is, e.g., 5 sheets of an A4-sized recording material. The certain number is set to such a number that the influence thereof on the image quality is little even when the image formation is interrupted and then the final image formation is effected without executing the operation in the forced consumption mode.

Specific description will be made. First, it is assumed that the number of sheets from the setting of the discharge execution flag to the end of the image forming job is 3 sheets and the predetermined corresponding number of sheets from the setting of the discharge execution flag to the execution of the operation in the forced consumption mode is 2 sheets. In this case, the operation in the forced consumption mode is executed after the image formation on remaining 3 sheets in the image forming job is ended, not immediately after the image formation on 2 sheets for which the discharge execution flag is set. That is, depending on a remaining number of sheets in the image forming job, the timing of execution of the operation in the forced consumption mode is executed may also be delayed.

[Specific Example of Operation in Forced Consumption Mode in this Embodiment]

Also in the above-described operation in the forced consumption mode, similarly as in compared Example, the following case will be considered. That is, the case where the "low-duty-black image chart" is formed on 104 sheets, and then the "high-duty-black image chart" is formed on one sheet, and thereafter the "low-duty-black image chart" is formed on one sheet, i.e., continuous image formation on 106 sheets in total is effected will be considered specifically.

Incidentally, in the case where each of the "low-duty-black image chart" and the "high-duty-black image chart" is formed on one surface of each of A4-sized sheets, how to add (integrate) the toner deterioration integrated value X for each color is the same as the case of the table described above with reference to FIG. 10.

Further, with respect to Y (yellow), M (magenta) and C (cyan), as shown in FIG. 10, the value added to the toner deterioration integrated value X is always the negative value. For this reason, as shown in the steps S35 and S36 in FIG. 12, the toner deterioration integrated value X is always in the state in which the toner deterioration integrated value X is reset to zero. For this reason, progression for K (black) will be described with reference to FIG. 13.

Figure 13:
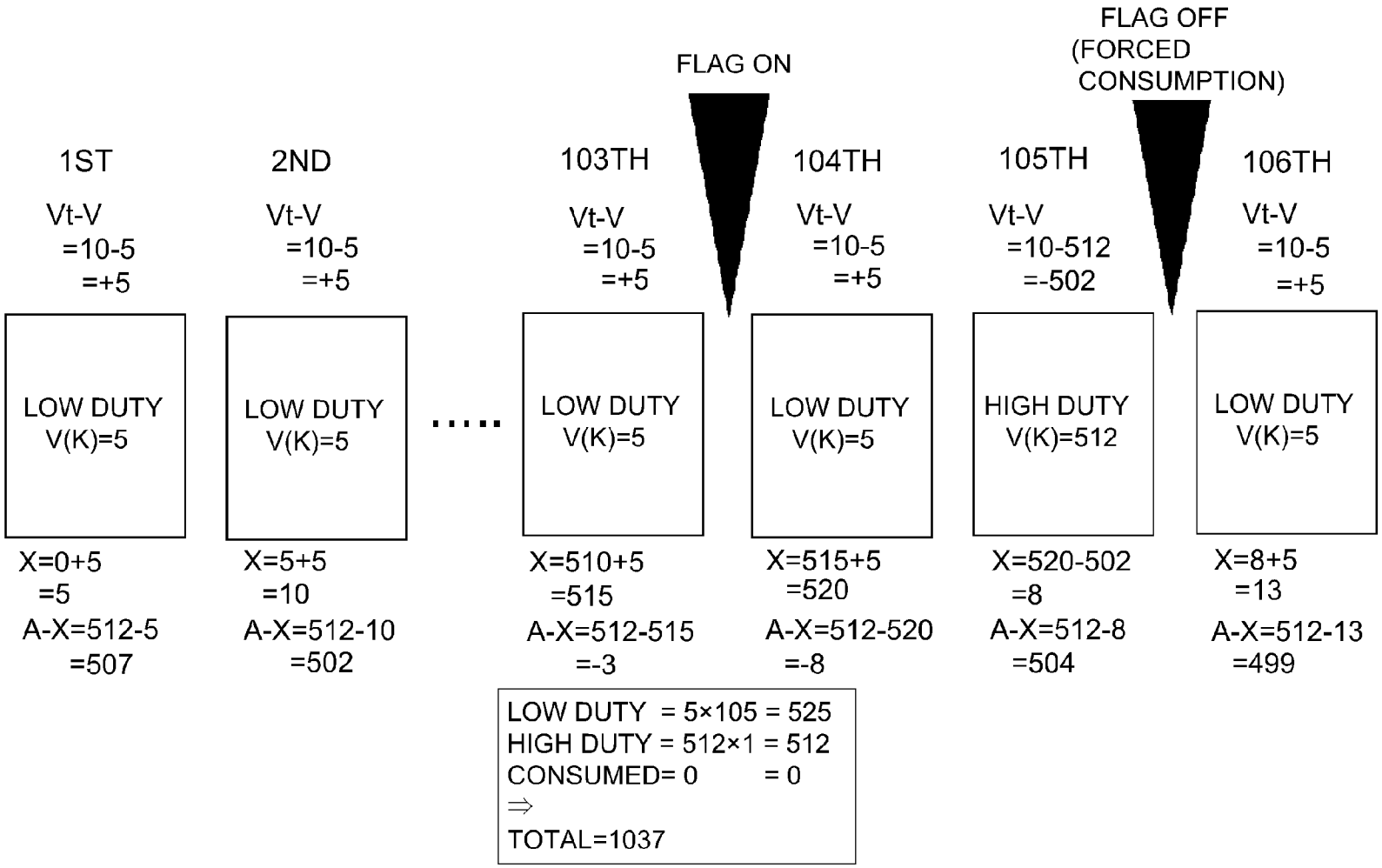
FIG. 13 is a schematic view showing a relationship among parameters in the case where the image of the low-duty-black is continuously formed in the embodiment.

As for K (black), as described above with reference to FIG. 10, during printing of the "low-duty-black image chart", the toner deterioration integrated value X is gradually integrated by +5. Accordingly, as shown in FIG. 13, from the first sheet to the 103-th sheet, the toner deterioration integrated value X is integrated and monotonically increased in the order of 5, 10, 15 . . . 515. Further, the value of the difference (A−X) between the toner discharge execution threshold A (=512) and the toner deterioration integrated value X is monotonically decreased, from the first sheet to the 102-th sheet in the order of 507, 502, 497 . . . 2, and at the 103-th sheet, the difference (A−X) is −3 which is the negative.

In this case, in accordance with the flowchart of FIG. 12, the discharge execution flag is set. However, as described above, in this embodiment, in a period from the setting of the discharge execution flag to the execution of the discharging operation in actuality, there is a time lag corresponding to the 2 sheets of the A4-sized recording material. Accordingly, the predetermined timing when the operation in the forced consumption mode is executable is after the image formation of the "high-duty-black image chart" on the 105-th sheet is ended.

Here, in this embodiment, using this time lag, calculation of the toner deterioration-integrated value X is continuously renewed, and therefore in the case where the image having the high image ratio is formed until the 105-th sheet for which the discharging operation is actually executed, such a flow that the discharge execution flag is reset is employed. Accordingly, in the above-described example, the image of the "high-duty-black image chart" is formed on the 105-th sheet of the recording material, and therefore the toner deterioration-integrated value X is remarkably reduced, so that the toner deterioration-integrated value X becomes 8. As a result, the discharge execution flag is reset, and the operation in the forced consumption mode is not executed in actuality, but the image of the "low-duty-black image chart" is formed on the 106-th sheet of the recording material. Finally, when the "low-duty-black image chart" is printed on the 106-th sheet, the toner deterioration integrated value X is 13, so that the difference (A−X) is 499.

From the above, with respect to K (black), a total toner consumption amount by the image formation on 106 sheets in the case where the operation is performed by a controller method in this embodiment will be estimated. Then, the respective video counts are 5×105=525 for 105 sheets of the "low-duty-black image chart", 512×1=512 for one sheet of the "high-duty-black image chart", and zero for no forced toner consumption. As a result, in this embodiment, the toner in the amount corresponding to the video count of 1037 in total is consumed.

[Comparison Between this Embodiment and Comparison Example]

As described above, the continuous image formation on 106 sheets in total including 104 sheets of the "low-duty-black image chart", one sheet of the "high-duty-black-image chart" and one sheet of the "low-duty-black image chart" is effected, the toner consumption amount is as follows. That is, in Comparison Example, the toner is consumed in an amount corresponding to the forced consumption of 1549 in total, and in the controller in this embodiment, the toner is consumed in an amount corresponding to the video count of 1037 in total. Therefore, in this embodiment, the toner consumption amount can be suppressed by approximately 33.1%.

Further, with respect to the image quality, also a maximum of the toner deterioration-integrated value in this embodiment is 520, so that an equivalent level to that in Comparison Example can be maintained. Further, with respect to the downtime, the number of execution times of the operation in the forced consumption mode is once in Comparison Example, but is zero in this embodiment, and therefore a downtime-reducing effect is also achieved in this embodiment.

As described above, according to this embodiment, in a constitution in which the operation in the forced consumption mode is executable, the toner consumption amount can be suppressed while suppressing the toner deterioration. That is, in the case where there is a time lag in the period from the setting of the discharge execution flag to the predetermined timing when the operation in the forced consumption mode is executable, when such a high-duty image that the toner is recovered from the deterioration in the period is formed, the discharge execution flag is reset. As a result, the operation in the forced consumption mode is prevented from being executed more than necessary, so that it is possible to suppress the toner consumption amount while suppressing the toner deterioration. Further, the operation in the forced consumption mode is not performed more than necessary, and therefore the downtime can be reduced.

Further, this embodiment is described as follows in accordance with the above-described example of FIG. 13. First, the case where the image formation on a first predetermined number of sheets (105 sheets) is effected at the same first image ratio (V=5) will be considered. In this case, the operation in the forced consumption mode is executed at predetermined timing immediately after the image formation on the first predetermined number of sheets. On the other hand, the case where the image formation is effected at a second image ratio (V=512) in a period from after the image formation on a second predetermined number of sheets (103 sheets) smaller than the first predetermined number of sheets is effected at the same first image ratio will be considered. The second image ratio is larger than the first image ratio. In this case, when the total number of sheets subjected to the image formation at the first image ratio and the second image ratio is the first predetermined number of sheets, the operation in the forced consumption mode is not executed at the predetermined timing (immediately after the 105-th sheet).

OTHER EMBODIMENTS

Figure 14:
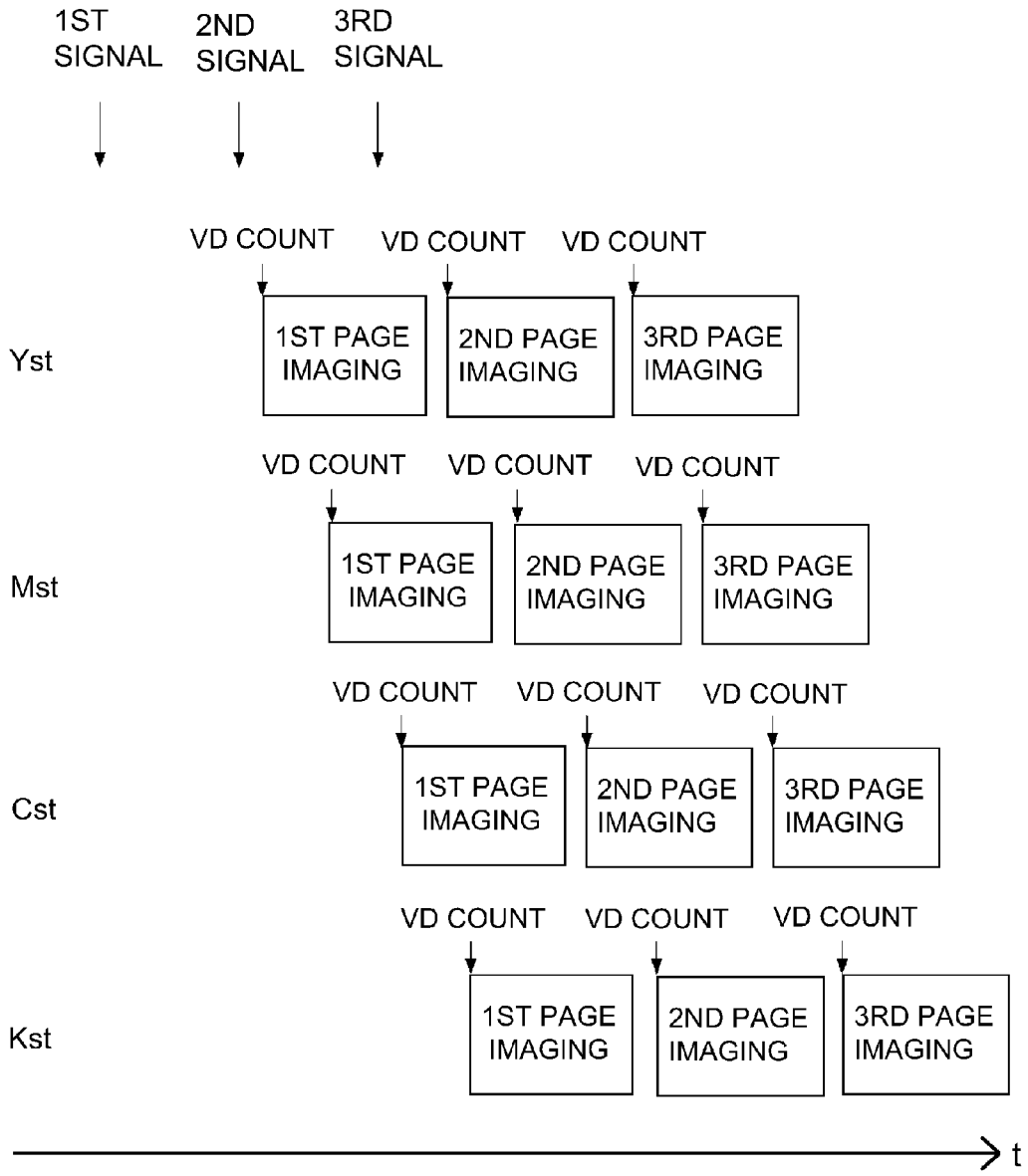
FIG. 14 is a schematic view showing image formation timing and notification timing of each of various signals from a controller.

The toner consumption amount-reducing effective varies depending on constitutions (value sheet number, intermittent number of sheets, sheet size, image duty, one-side/double-side, etc.) of the print job. The time lag from the setting of the discharge execution flag to the actual execution of the operation in the forced consumption mode also varies depending on the constitutions of the image forming apparatus. For example, as shown in FIG. 14, depending on the feeding enabling signal timing and the yellow image formation timing, the time lag generates also in the execution of the operation in the forced consumption mode of the yellow toner. Further, the downtime-reducing effect varies also depending on the constitutions of the print job and the process speed of the image forming apparatus. Incidentally, the "unit sheet number" is the number of sheets subjected to image formation in one image forming job. Accordingly, in the above, the description is made using an example in which the effect of the present invention is easy to understand.

Further, in the above description, an example of the continuous image formation on one surface sized recording material was described. However, the toner deterioration depends on a consumption amount) per unit time in the developing device, and therefore even when the image with the same print ratio is formed, compared with the continuous image formation, during intermittent image formation, progression of the toner deterioration is early correspondingly to a driving time of the developing device before and after the image formation. Here, the intermittent image formation refers to, in the case of one-sheet intermittent image formation, the case where the image formation on one sheet is effected in one job. In the one sheet intermittent image formation, the pre-rotation operation, the image formation on one sheet and the post-rotation operation are performed. Accordingly, in the case of the one-sheet intermittent image formation, when the image formation on the same number of sheets as that in the continuous image formation is effected, the pre-rotation operation and the post-rotation operation are performed every image formation, and therefore the driving time of the developing device becomes long. Accordingly, in this embodiment, from the video count per one sheet, the toner deterioration-integrated value was calculated, but may also be calculated on the basis of a print ratio standardized per unit driving time of the developing device.

Further, the predetermined condition for executing the operation in the forced consumption mode is not only discriminated from such a toner deterioration-integrated value but also may also be discriminated by another means if the toner consumption amount by the image formation is small and the toner deterioration state can be discriminated.

According to the present invention, the toner consumption amount can be suppressed while suppressing the toner deterioration in a constitution in which the operation in the forced consumption mode is executable.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-252134 filed on Dec. 12, 2014, which is hereby incorporated by reference herein in its entirety.

What is claimed is:

1. An image forming apparatus capable of executing a continuous image forming job for continuously forming images on a plurality of recording materials comprising:

an image forming unit including an image bearing member and a developing device configured to develop, with toner, an electrostatic latent image formed on said image bearing member; and a controller configured to cause said image forming unit to execute an operation in a toner supplying mode in which the continuous image forming job is interrupted, and in a state that the continuous image forming job is interrupted, the electrostatic latent image formed on said image bearing member is developed by said developing device and then the toner is supplied to said image bearing member, wherein said controller is capable of causing said image forming unit to execute the operation in the toner supplying mode on the basis of information on an amount of the toner consumed by formation of the images formed on the plurality of recording materials in the continuous image forming job, wherein said controller (i) causes said image forming unit to execute the operation in the toner supplying mode with an end of execution of formation of the images on the recording materials in a first number of sheets in the continuous image forming job in a case that an amount of the toner consumed by formation of the images formed on the recording materials in the first number of sheets in the continuous image forming job is a first predetermined amount and that the continuous image forming job is completed by the end of execution of formation of the images on the recording materials in the first number of sheets in the continuous image forming job, (ii) causes said image forming unit to execute the operation in the toner supplying mode with an end of execution of formation of the images on the recording materials in a second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that an amount of the toner consumed by formation of the images formed on the recording materials in the second number of sheets subsequent to the recording materials in the first number of sheets in the continuous image forming job is not more than a second predetermined amount, and (iii) causes said image forming unit not to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is more than the second predetermined amount.

2. The image forming apparatus according to claim 1, wherein said controller causes said image forming unit to execute the operation in the toner supplying mode so that an amount of the toner supplied to said image bearing member when said controller causes said image forming unit to execute the operation in the toner supplying mode with the end of execution of formation of the images on the recording materials in the first number of sheets in the continuous image forming job in a case that an amount of the toner consumed by formation of the images formed on the recording materials in the first number of sheets in the continuous image forming job is the first predetermined amount and that the continuous image forming job is completed by the end of execution of formation of the images on the recording materials in the first number of sheets in the continuous image forming job, and an amount of the toner supplied to said image bearing member when said controller causes said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is not more than the second predetermined amount are equal to each other.

3. The image forming apparatus according to claim 1, wherein said controller causes said image forming unit to execute the operation in the toner supplying mode so that an amount of the toner supplied to said image bearing member when said controller causes said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is not more than the second predetermined amount, is larger than an amount of the toner supplied to said image bearing member when said controller causes said image forming unit to execute the operation in the toner supplying mode with the end of execution of formation of the images on the recording materials in the first number of sheets in the continuous image forming job in a case that an amount of the toner consumed by formation of the images formed on the recording materials in the first number of sheets in the continuous image forming job is the first predetermined amount and that the continuous image forming job is completed by the end of execution of formation of the images on the recording materials in the first number of sheets in the continuous image forming job.

4. The image forming apparatus according to claim 1, wherein said controller causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is not more than the second predetermined amount and the continuous image forming job is completed by the end of execution of formation of the images on the recording materials in the second number of sheets in the continuous image forming job, causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job, that the amount of the toner consumed by formation of the images formed on the recording materials in the second number of sheets subsequent to the recording materials in the first number of sheets in the continuous image forming job is not more than the second predetermined amount and the continuous image forming job is not completed by the end of execution of formation of the images on the recording materials in the second number of sheets in the continuous image forming job, and that formation of the recording material in a third number of sheets subsequent to the recording materials in the second number of sheets in the continuous image formation is executed from an end of execution of formation of the images on the recording materials in the second number of sheets in the continuous image forming job until the continuous image forming job is completed and the third number of sheets is more than a predetermined number of sheets, and causes said image forming unit to execute the operation in the toner supplying mode with an end of execution of formation of the images on the recording materials in a fourth number of sheets in the continuous image forming job without causing said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job, that the amount of the toner consumed by formation of the images formed on the recording materials in the second number of sheets subsequent to the recording materials in the first number of sheets in the continuous image forming job is not more than the second predetermined amount and the continuous image forming job is not completed by the end of execution of formation of the images on the recording materials in the second number of sheets in the continuous image forming job, and that formation of the recording material in a fourth number of sheets subsequent to the recording materials in the second number of sheets in the continuous image formation is executed from an end of execution of formation of the images on the recording materials in the second number of sheets in the continuous image forming job until the continuous image forming job is completed and the fourth number of sheets is not more than the predetermined number of sheets.

5. An image forming apparatus capable of executing a continuous image forming job for continuously forming images on a plurality of recording materials comprising:

an image forming unit including an image bearing member and a developing device configured to develop, with toner, an electrostatic latent image formed on said image bearing member; and a controller configured to cause said image forming unit to execute an operation in a toner supplying mode in which the continuous image forming job is interrupted, and in a state that the continuous image forming job is interrupted, the electrostatic latent image formed on said image bearing member is developed by said developing device and then the toner is supplied to said image bearing member, wherein said controller is capable of causing said image forming unit to execute the operation in the toner supplying mode on the basis of information on an amount of the toner consumed by formation of the images formed on the plurality of recording materials in the continuous image forming job, wherein said controller (i) causes said image forming unit to execute the operation in the toner supplying mode with an end of execution of formation of the images on the recording materials in a first number of sheets in the continuous image forming job in a case that an amount of the toner consumed by formation of the images formed on the recording materials in the first number of sheets in the continuous image forming job is a first predetermined amount and that the continuous image forming job is completed by the end of execution of formation of the images on the recording materials in the first number of sheets in the continuous image forming job, (ii) causes said image forming unit to execute the operation in the toner supplying mode with an end of execution of formation of the images on the recording materials in a second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that an amount of the toner consumed by formation of the images formed on the recording materials in the second number of sheets subsequent to the recording materials in the first number of sheets in the continuous image forming job is not more than a second predetermined amount, said controller causing said image forming unit to execute the operation in the toner supplying mode so that an amount of the toner supplied to said image bearing member when said controller causes said image forming unit to execute the operation in the toner supplying mode with the end of execution of formation of the images on the recording materials in the first number of sheets in the continuous image forming job in a case that an amount of the toner consumed by formation of the images formed on the recording materials in the first number of sheets in the continuous image forming job is the first predetermined amount and that the continuous image forming job is completed by the end of execution of formation of the images on the recording materials in the first number of sheets in the continuous image forming job, and an amount of the toner supplied to said image bearing member when said controller causes said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is not more than the second predetermined amount are equal to each other, and (iii) causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is more than the second predetermined amount, said controller causing said image forming unit to execute the operation in the toner supplying mode so that an amount of the toner supplied to said image bearing member when said controller causes said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is more than the second predetermined amount, is smaller than an amount of the toner supplied to said image bearing member when said controller causes said image forming unit to execute the operation in the toner supplying mode with the end of execution of formation of the images on the recording materials in the first number of sheets in the continuous image forming job in a case that an amount of the toner consumed by formation of the images formed on the recording materials in the first number of sheets in the continuous image forming job is the first predetermined amount and that the continuous image forming job is completed by the end of execution of formation of the images on the recording materials in the first number of sheets in the continuous image forming job.

6. The image forming apparatus according to claim 5, wherein said controller causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is not more than the second predetermined amount and the continuous image forming job is completed by the end of execution of formation of the images on the recording materials in the second number of sheets in the continuous image forming job, causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job, that the amount of the toner consumed by formation of the images formed on the recording materials in the second number of sheets subsequent to the recording materials in the first number of sheets in the continuous image forming job is not more than the second predetermined amount and the continuous image forming job is not completed by the end of execution of formation of the images on the recording materials in the second number of sheets in the continuous image forming job, and that formation of the recording material in a third number of sheets subsequent to the recording materials in the second number of sheets in the continuous image formation is executed from an end of execution of formation of the images on the recording materials in the second number of sheets in the continuous image forming job until the continuous image forming job is completed and the third number of sheets is more than a predetermined number of sheets, and causes said image forming unit to execute the operation in the toner supplying mode with an end of execution of formation of the images on the recording materials in a fourth number of sheets in the continuous image forming job without causing said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job, that the amount of the toner consumed by formation of the images formed on the recording materials in the second number of sheets subsequent to the recording materials in the first number of sheets in the continuous image forming job is not more than the second predetermined amount and the continuous image forming job is not completed by the end of execution of formation of the images on the recording materials in the second number of sheets in the continuous image forming job, and that formation of the recording material in a fourth number of sheets subsequent to the recording materials in the second number of sheets in the continuous image formation is executed from an end of execution of formation of the images on the recording materials in the second number of sheets in the continuous image forming job until the continuous image forming job is completed and the fourth number of sheets is not more than the predetermined number of sheets.

7. The image forming apparatus according to claim 5, wherein said controller causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job and that the amount of the toner consumed by formation of the images formed on the recording materials in the second number of sheets subsequent to the recording materials in the first number of sheets in the continuous image forming job is more than the second predetermined amount and the continuous image forming job is completed by the end of execution of formation of the images on the recording materials in the second number of sheets in the continuous image forming job, causes said image forming unit to execute the operation in the toner supplying mode with an end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job, that the amount of the toner consumed by formation of the images formed on the recording materials in the second number of sheets subsequent to the recording materials in the first number of sheets in the continuous image forming job is more than the second predetermined amount and the continuous image forming job is not completed by the end of execution of formation of the images on the recording materials in the second number of sheets in the continuous image forming job, and that formation of the recording material in a third number of sheets subsequent to the recording materials in the second number of sheets in the continuous image formation is executed from an end of execution of formation of the images on the recording materials in the second number of sheets in the continuous image forming job until the continuous image forming job is completed and the third number of sheets is more than a predetermined number of sheets, and causes said image forming unit to execute the operation in the toner supplying mode with an end of execution of formation of the images on the recording materials in a fifth number of sheets in the continuous image forming job without causing said image forming unit to execute the operation in the toner supplying mode with the end of execution of formation of the images on the recording materials in the second number of sheets in the continuous image forming job in a case that the amount of the toner consumed by formation of the images formed on the recording materials in the first number of sheets in the continuous image forming job is the first predetermined amount and the continuous image forming job is not completed by the end of execution of formation of the images on the recording materials in the first number of sheets in the continuous image forming job, that the amount of the toner consumed by formation of the images formed on the recording materials in the second number of sheets subsequent to the recording materials in the first number of sheets in the continuous image forming job is more than the second predetermined amount and the continuous image forming job is not completed by the end of execution of formation of the images on the recording materials in the second number of sheets in the continuous image forming job, and that formation of the recording material in a sixth number of sheets subsequent to the recording materials in the second number of sheets in the continuous image formation is executed from an end of execution of formation of the images on the recording materials in the second number of sheets in the continuous image forming job until the continuous image forming job is completed and the sixth number of sheets is not more than the predetermined number of sheets.

* * * * *